US011164533B2

(12) United States Patent
Park et al.

(10) Patent No.: US 11,164,533 B2
(45) Date of Patent: Nov. 2, 2021

(54) DISPLAY DEVICE

(71) Applicant: Samsung Display Co. Ltd., Yongin-si (KR)

(72) Inventors: Jun Hyun Park, Suwon-si (KR); Sun Kwang Kim, Seoul (KR); Young Wan Seo, Suwon-si (KR); Cheol Gon Lee, Suwon-si (KR); Yang Hwa Choi, Hwaseong-si (KR)

(73) Assignee: SAMSUNG DISPLAY CO. LTD., Yongin-si (KR)

( * ) Notice: Subject to any disclaimer, the term of this patent is extended or adjusted under 35 U.S.C. 154(b) by 0 days.

(21) Appl. No.: 17/093,876

(22) Filed: Nov. 10, 2020

(65) Prior Publication Data

US 2021/0082353 A1 Mar. 18, 2021

Related U.S. Application Data

(63) Continuation of application No. 16/569,027, filed on Sep. 12, 2019, now Pat. No. 10,839,757.

(30) Foreign Application Priority Data

Sep. 17, 2018 (KR) ..... 10-2018-0110743
Jun. 11, 2019 (KR) ..... 10-2019-0068519

(51) Int. Cl.

| | |
|---|---|
| ***G09G 3/3291*** | (2016.01) |
| ***G09G 3/3258*** | (2016.01) |
| ***G09G 3/3233*** | (2016.01) |
| ***G09G 3/3266*** | (2016.01) |

(52) U.S. Cl.

CPC ..... *G09G 3/3291* (2013.01); *G09G 3/3233* (2013.01); *G09G 3/3258* (2013.01); *G09G 3/3266* (2013.01)

(58) Field of Classification Search

CPC .. G09G 3/3291; G09G 3/3233; G09G 3/3258; G09G 3/3266

See application file for complete search history.

(56) References Cited

U.S. PATENT DOCUMENTS

| | | | |
|---|---|---|---|
| 9,805,651 | B2 | 10/2017 | Kim |
| 2019/0035336 | A1 | 1/2019 | Park et al. |
| 2020/0051472 | A1 | 2/2020 | Ju et al. |

*Primary Examiner* — Michael Pervan

(74) *Attorney, Agent, or Firm* — Kile Park Reed & Houtteman PLLC

(57) ABSTRACT

A display device includes a data line to which a data voltage is applied, a first driving voltage line to which a first driving voltage is applied, a second driving voltage line to which a second driving voltage is applied, and a pixel connected to the first and second driving voltage lines. The pixel includes a first transistor to control a driving current according to a voltage applied to a first node, a light emitting element between the first transistor and the first driving voltage line, and a capacitor between the first node and the second driving voltage line. The first driving voltage has a first high-level voltage during a first initialization period, the first driving voltage has a first mid-level voltage lower than the first high level voltage during a threshold-voltage-storage period, and the first driving voltage has a first low-level voltage during a second initialization period.

20 Claims, 54 Drawing Sheets

DISPLAY DEVICE

CROSS-REFERENCE TO RELATED APPLICATION(S)

This is a continuation application of U.S. patent application Ser. No. 16/569,027 filed Sep. 12, 2019 (now pending), the disclosure of which is incorporated herein by reference in its entirety. U.S. patent application Ser. No. 16/569,027 claims priority benefit of Korean Patent Application No. 10-2018-0110743 filed Sep. 17, 2018 in the Korean Intellectual Property Office and Korean Patent Application No. 10-2019-0068519 filed Jun. 11, 2019 in the Korean Intellectual Property Office, the disclosures of which are incorporated herein by reference in their entirety for all purposes.

BACKGROUND

1. Field

The present disclosure relates to a display device.

2. Description of the Related Art

With development of information-oriented society, the demand for display devices for displaying images has increased in various forms. For example, a display device is applied to various electronic devices such as a smartphone, a digital camera, a laptop, a navigation system, and a smart television. The display device may be a flat panel display device such as a liquid crystal display device, a field emission display device, an organic light emitting display device, or the like. Among such flat panel display devices, the organic light emitting display device includes a light emitting element that allows each pixel of a display panel to emit light by itself such that the organic light emitting display device is able to display an image even without a backlight unit that provides light to the display panel.

Each pixel of the organic light emitting display device may include the light emitting element, a driving transistor configured to adjust the amount of driving current supplied from a power line to the light emitting element according to a voltage of a gate electrode, and a scan transistor configured to supply a data voltage of a data line to the gate electrode of the driving transistor in response to a scan signal of a scan line. In this case, when the light emitting element emits light with a low-gradation luminance, since the driving current is small, the time taken for charging a parasitic capacitance of the light emitting element may be increased. Thus, light emission of the light emitting element may be delayed in the pixel, and a low-gradation stain may occur due to the pixel failing to express a gradation attempted to be expressed.

SUMMARY

One or more example embodiments of the present disclosure provide a display device includes: an initialization voltage line to which an initialization voltage is applied; a first driving voltage line to which a first driving voltage is applied; and a pixel connected to the initialization voltage line and the first driving voltage line. The pixel includes a first transistor configured to control a driving current flowing between a first electrode and a second electrode according to a voltage applied to a first node; a light emitting element between the first transistor and the first driving voltage line, the light emitting element having a first electrode connected to the first transistor and a second electrode connected to the first driving voltage line; and a first capacitor between the first node and the initialization voltage line. The initialization voltage is changed from a first level voltage to a second level voltage lower than the first level voltage during an initialization period in which the first electrode of the light emitting element is initialized. The first driving voltage is changed from a first high-level voltage to a first low-level voltage which is lower than the first high-level voltage during the initialization period.

One or more example embodiments of the present disclosure provide a display device include a first driving voltage line to which a first driving voltage is applied; a second driving voltage line to which a second driving voltage is applied; and a pixel connected to the first driving voltage line and the second driving voltage line. The pixel includes a first transistor configured to control a driving current flowing between a first electrode and a second electrode according to a voltage applied to a first node and a light emitting element between the first transistor and the first driving voltage line, the light emitting element having a first electrode connected to the first transistor and a second electrode connected to the first driving voltage line. The first driving voltage is changed from a first high-level voltage to a first low-level voltage which is lower than the first high-level voltage during a period in which the first electrode of the light emitting element is initialized. The second driving voltage has a second low-level voltage during the period in which the first electrode of the light emitting element is initialized.

BRIEF DESCRIPTION OF THE DRAWINGS

Features will become apparent to those of skill in the art by describing in detail exemplary embodiments with reference to the attached drawings in which.

DETAILED DESCRIPTION

The present disclosure will now be described more fully hereinafter with reference to the accompanying drawings, in which preferred embodiments of the disclosure are shown. This disclosure may, however, be embodied in different forms and should not be construed as limited to the embodiments set forth herein. Rather, these embodiments are provided so that this disclosure will be thorough and complete, and will filly convey the scope of the disclosure to those skilled in the art. The same reference numbers indicate the same components throughout the specification. In the attached figures, the thickness of layers and regions is exaggerated for clarity.

It will also be understood that when a layer is referred to as being "on" another layer or substrate, it can be directly on the other layer or substrate, or intervening layers may also be present. In contrast, when an element is referred to as being "directly on" another element, there are no intervening elements present.

Hereinafter, embodiments of the present disclosure will be described with reference to the attached drawings.

Figure 1:
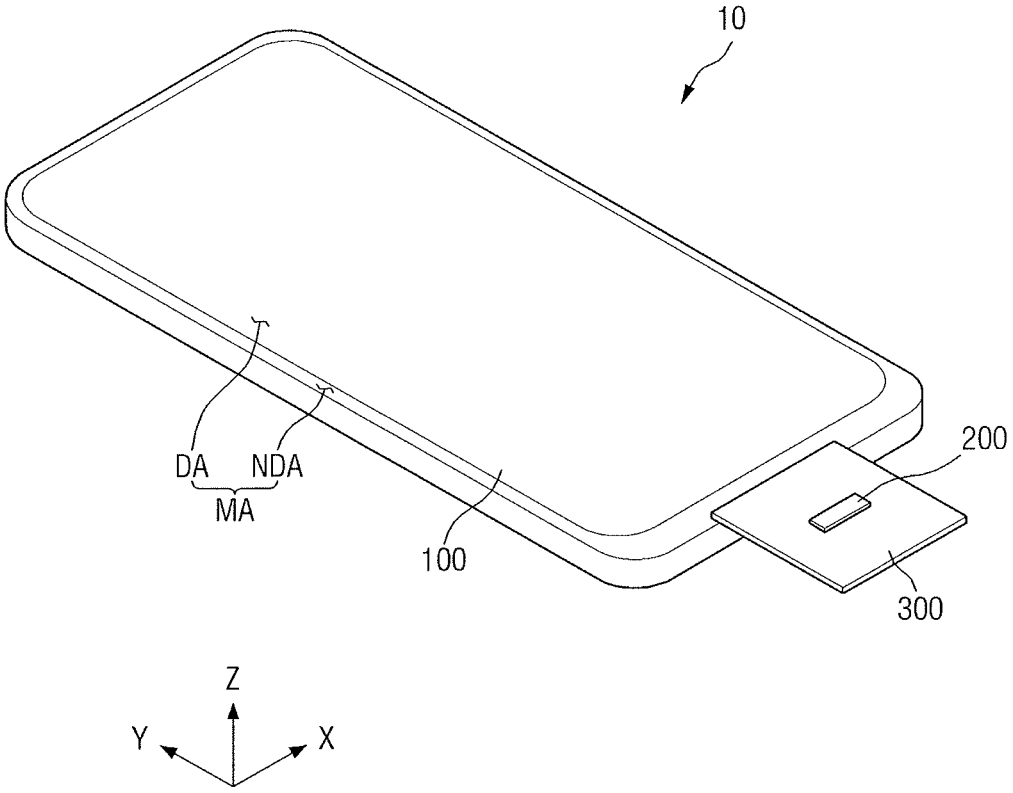
FIG. 1 illustrates a perspective view of a display device according to an embodiment.
Figure 2:
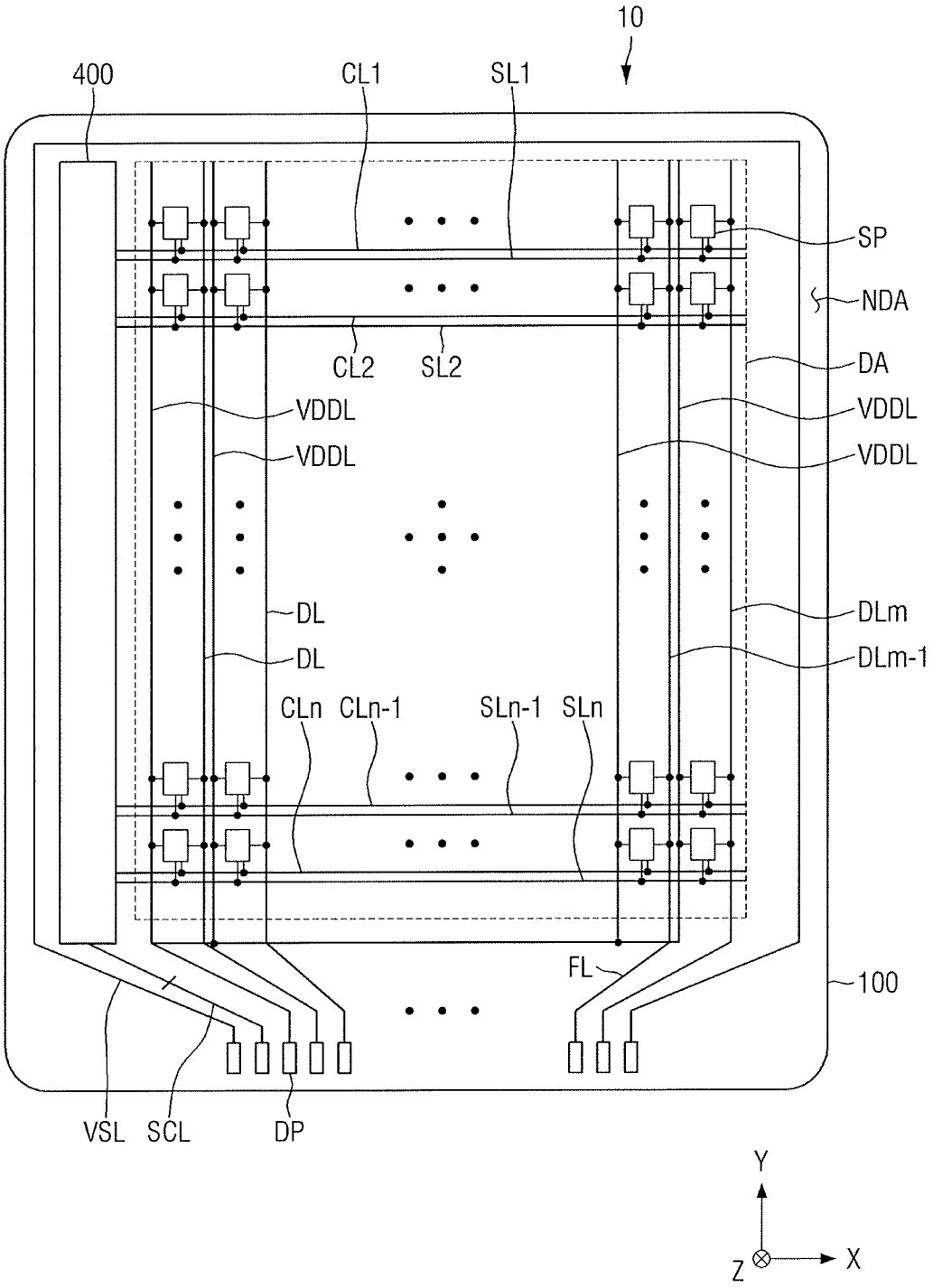
FIG. 2 illustrates a plan view of the display device according to an embodiment.
Figure 3:
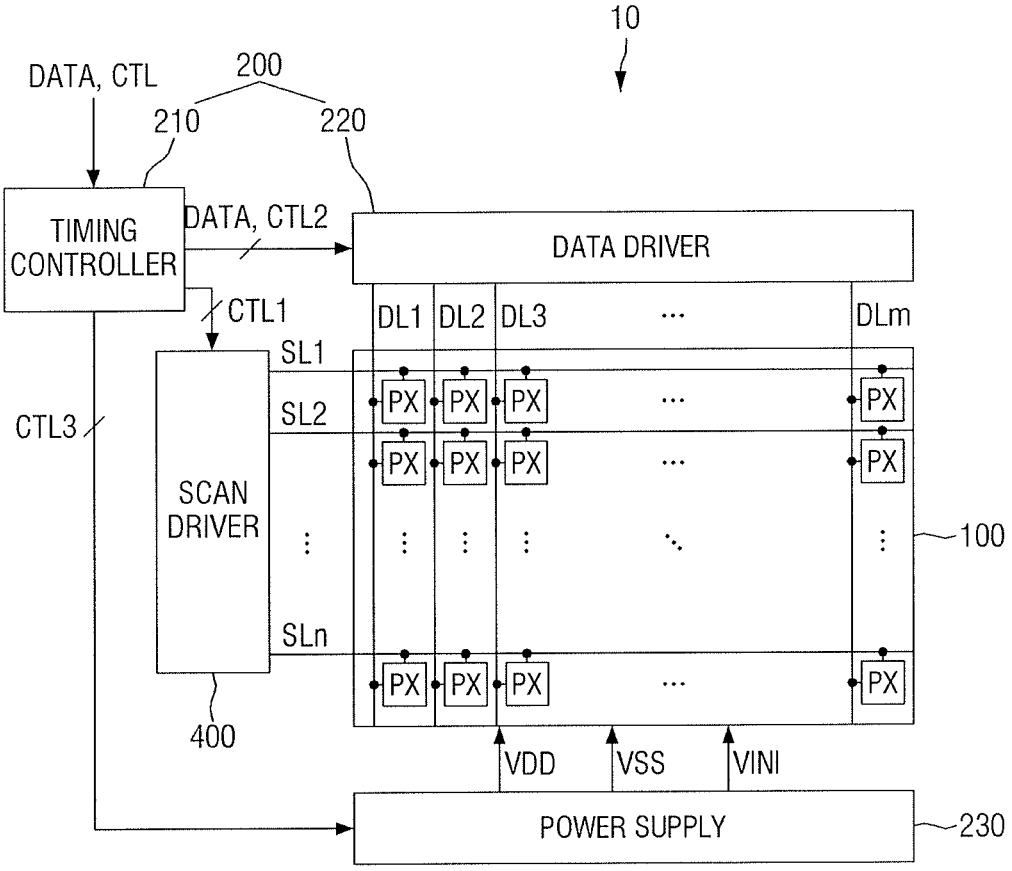
FIG. 3 illustrates a display device according to an embodiment.

FIG. 1 is a perspective view illustrating a display device according to an embodiment. FIG. 2 is a plan view illustrating the display device according to an embodiment. FIG. 3 illustrates the display device according to an embodiment.

In the present specification, "upper portion," "top," and "upper surface" indicate an upward direction, i.e., a Z-axis direction, from a display panel 100, and "lower portion," "bottom," and "lower surface" indicate a downward direction, i.e., an opposite direction of the Z-axis direction, from the display panel 100. Also, "leftward," "rightward," "upward," and "downward" indicate directions when the display panel 100 is viewed from a plane. For example, "leftward" indicates an opposite direction of an X-axis direction, "rightward" indicates the X-axis direction, "upward" indicates a Y-axis direction, and "downward" indicates an opposite direction of the Y-axis direction.

Referring to FIGS. 1 to 3, a display device 10 is a device for displaying a video or still images. The display device 10 may be used as a display screen of not only portable electronic devices, e.g., a mobile phone, a smartphone, a tablet personal computer (PC), a smart watch, a watch phone, a mobile communication terminal, an electronic note, an electronic book, a portable multimedia player (PMP), a navigation system, an ultra-mobile PC (UMPC), and so forth, but also various other products, e.g., a television, a laptop, a monitor, a billboard, Internet-of-Things (IoT) devices, and so forth.

The display device 10 may be a light emitting display device such as an organic light emitting display device that uses an organic light emitting diode (OLED), a quantum dot light emitting display device that includes a quantum dot emissive layer, an inorganic light emitting display device that includes an inorganic semiconductor, and a micro light emitting display device that uses a micro LED. Hereinafter, description will be given by assuming that the display device 10 is an organic light emitting display device, but embodiments may be applied to other types of display devices.

The display device 10 includes the display panel 100, a display driving circuit 200, and a circuit board 300.

The display panel 100 may be formed of a rectangular plane having a short side in a first direction (X-axis direction) and a long side in a second direction (Y-axis direction) crossing the first direction (X-axis direction). A corner at which the short side in the first direction (X-axis direction) and the long side in the second direction (Y-axis direction) meet may be rounded to have a predetermined curvature, may be right-angled, may be chamfered, and so forth. The planar form of the display panel 100 is not limited to quadrangular, but may be other polygonal shapes, circular, or elliptical. The display panel 100 may be flat or may include curved portions at opposing ends and have a constant curvature or a varying curvature. In addition, the display panel 100 may be flexible, e.g., bendable, foldable, and/or rollable.

The display panel 100 may include a display area DA in which subpixels SP are formed and thus an image is displayed and a non-display area NDA which is a surrounding area of the display area DA. In addition to the subpixels SP, scan lines SL1 to SLn, control scan lines CL1 to CLn, data lines DL1 to DLm, a first driving voltage line VSL, and second driving voltage lines VDL, which are connected to the subpixels SP, may be disposed in the display area DA. The scan lines SL1 to SLn and the control scan lines CL1 to CLn may be formed in parallel in the first direction (X-axis direction), and the data lines DL1 to DLm may be formed in parallel in the second direction (Y-axis direction) crossing the first direction (X-axis direction). The second driving voltage lines VDL may be formed in parallel in the second direction (Y-axis direction) in the display area DA. The second driving voltage lines VDS which are formed in parallel in the second direction (Y-axis direction) in the display area DA may be connected to each other in the non-display area NDA.

Each subpixel SP may be connected to at least one of the scan lines SL1 to SLn, any one of the data lines DL1 to DLm, at least one of the control scan lines CL1 to CLn, and the second driving voltage line VDL. Also, each subpixel SP may be electrically connected to the first driving voltage line VSL. Although the case in which each subpixel SP is connected to a single scan line, a single data line, a single control scan line, and a single second driving voltage line VDL has been illustrated as an example in FIG. 2, embodiments are not limited thereto.

Each subpixel SP may include a plurality of transistors, a light emitting element, and a capacitor. The plurality of transistors may include a driving transistor, which is configured to control a driving current flowing in the light emitting element according to a data voltage applied to a gate electrode, and at least one switching transistor. The plurality of transistors may be thin film transistors. The light emitting element may emit light according to the driving current of the driving transistor. The capacitor may serve to maintain a data voltage applied to a gate electrode of a driving transistor DT constant.

The non-display area NDA may be defined as a surrounding area of the display area DA. A scan driver 400 configured to apply scan signals to the scan lines SL1 to SLn, fan outlines FL connected to pads DP, and the pads DP connected to the circuit board 300 may be disposed in the non-display area NDA. The pads DP may be disposed at one-side edge of the display panel 100.

The scan driver 400 may be connected to the pads DP via a plurality of scan control lines SCL. Thus, the scan driver 400 may receive a scan control signal CTL1 of the display driving circuit 200 via the plurality of scan control lines SCL. The scan driver 400 may generate scan signals according to the scan control signal CTL1 and sequentially output the scan signals to the scan lines to SLn.

The scan driver 400 may include a plurality of thin film transistors. The scan driver 400 may be formed at the same layer as the thin film transistors of the subpixels SP.

Although the case in which the scan driver 400 is formed at one side of the display area DA, e.g., the non-display area NDA at the left side, has been illustrated as an example in FIG. 2, embodiments are not limited thereto. For example, the scan driver 400 may be formed at both sides of the display area DA, e.g., the non-display areas NDA at the left and right sides.

The display driving circuit 200 may be formed as an integrated circuit (IC) and disposed on the circuit board 300. Alternatively, the display driving circuit 200 may be disposed on the display panel 100 using a chip-on-glass (COG) method, a chip-on-plastic (COP) method, or an ultrasonic bonding method. The display driving circuit 200 may include a timing controller 210 and a data driver 220 as illustrated in FIG. 3.

The timing controller 210 receives digital video data DATA and timing signals CTL. The timing controller 210 may generate a scan control signal CTL1 for controlling an operation timing of the scan driver 400 according to the timing signals CTL and generate a data control signal CTL2 for controlling an operation timing of the data driver 220. The timing controller 210 may generate a power control signal CTL3 for controlling an operation timing of a power supply circuit 230. The timing controller 210 may output the scan control signal CTL1 to the scan driver 400 via the plurality of scan control lines SCL and output the digital video data DATA and the data control signal CTL2 to the data driver 220. The timing controller 210 may output the power control signal CTL3 to the power supply circuit 230.

The data driver 220 converts the digital video data DATA into analog positive/negative data voltages and outputs the data voltages to the data lines DL1 to DLm via the fan outlines FL. The subpixels SP are selected by the scan signals of the scan driver 400, and the data voltages are supplied to the selected subpixels SP.

The power supply circuit 230 may be formed as an IC and disposed on the circuit board 300. The power supply circuit 230 may generate a first driving voltage VSS according to input power and the power control signal CTL3 and supply the generated first driving voltage VSS to the first driving voltage line VSL, may generate a second driving voltage VDD and supply the generated second driving voltage VDD to the second driving voltage line VDL, and may generate an initialization voltage VINI and supply the generated initialization voltage VINI to an initialization voltage line. The power supply circuit 230 may generate various driving voltages necessary for driving the display device 10 other than the first driving voltage, the second driving voltage, and the initialization voltage. The power supply circuit 230 may be a DC-DC converter.

The circuit board 300 may be attached onto the pads DP using an anisotropic conductive film. Thus, the circuit board 300 may be electrically connected to the pads DP. The circuit board 300 may be a flexible film, e.g., a flexible printed circuit board, a printed circuit board, a chip-on-film, and the like.

Figure 4:
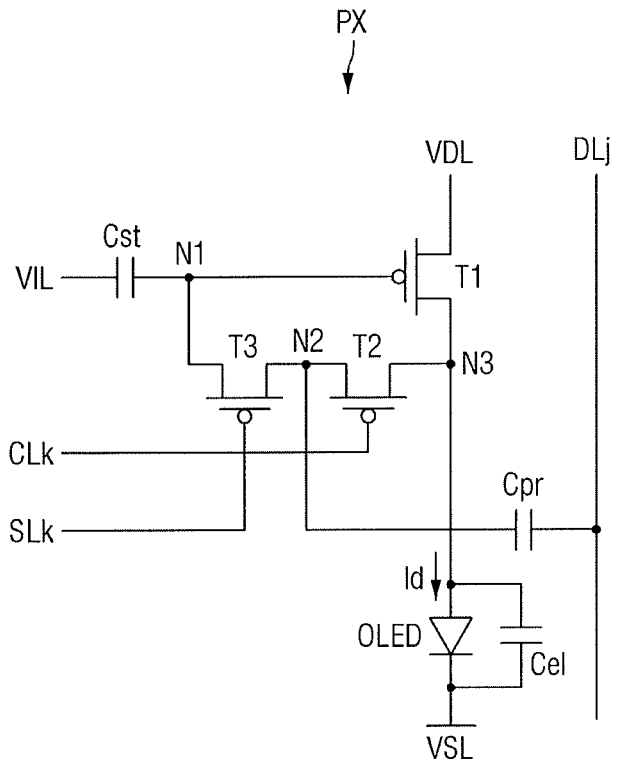
FIG. 4 illustrates a circuit diagram specifically showing an example of a subpixel according to an embodiment.

FIG. 4 is a circuit diagram specifically showing a subpixel according to an embodiment. Referring to FIG. 4, a subpixel PX may be connected to a k-th (where k is a positive integer) scan line SLk, a k-th control scan line CLk, a j-th (where j is a positive integer) data line DLj, an initialization voltage line VIL to which an initialization voltage is applied, a first driving voltage line VSL to which a first driving voltage is applied, and a second driving voltage line VDL to which a second driving voltage is applied. The subpixel PX may include an organic light emitting diode OLED as a light emitting element, a first transistor T1, a second transistor T2, a third transistor T3, a first capacitor Cst, and a second capacitor Cpr.

Although the case in which the first, second, and third transistors T1, T2, and T3 are formed as p-channel metal-oxide semiconductor (PMOS) transistors has been illustrated as an example in FIG. 4, embodiments are not limited thereto. For example, the first, second, and third transistors T1, T2, and T3 may be formed as n-channel metal-oxide semiconductor (NMOS) transistors, or some of the first, second, and third transistors T1, T2, and T3 may be formed as PMOS transistors and the remainder thereof may be formed as an NMOS transistor. The PMOS transistor is turned on by a gate-on voltage which is lower than a gate-off voltage, and the NMOS transistor is turned on by a gate-on voltage which is higher than a gate-off voltage.

The organic light emitting diode OLED is a light emitting element and emits light according to a driving current Id of the first transistor T1. A light-emitting luminance of the organic light emitting diode OLED may be proportional to the driving current Id.

The organic light emitting diode OLED may be an organic light emitting diode OLED including a first electrode, a second electrode, and an organic emissive layer disposed between the first electrode and the second electrode. Alternatively, instead of the organic light emitting diode OLED, an inorganic LED including a first electrode, a second electrode, and an inorganic semiconductor between the first electrode and the second electrode may be used as the light emitting element. Alternatively, instead of the organic light emitting diode OLED, a quantum dot LED including a first electrode, a second electrode, and a quantum dot emissive layer disposed between the first electrode and the second electrode may be used as the light emitting element. Alternatively, instead of the organic light emitting diode OLED, a micro LED may be used as the light emitting element.

The first electrode of the organic light emitting diode OLED may be connected to a third node, and the second electrode may be connected to the first driving voltage line VSL. A parasitic capacitance Cel may be formed between the first electrode and the second electrode of the organic light emitting diode OLED.

The first transistor T1 may be a driving transistor that controls a drain-source current Ids (hereinafter referred to as "driving current") according to the data voltage applied to the gate electrode. As shown in Equation 1, the driving current Id flowing via the channel of the first transistor T1 is proportional to a square of a difference between a voltage Vgs between the gate electrode and the first electrode of the first transistor T1 and a threshold voltage of the first transistor T1.

$$ID=k'\times(Vsg-Vth)^2 \quad \text{[Equation 1]}$$

In Equation 1, k' represents a proportional coefficient determined by electron mobility of the channel of the first transistor T1 or the width, length, or the like of the channel; Vgs represents the voltage between the gate electrode and the first electrode of the driving transistor; and Vth represents the threshold voltage of the first transistor T1.

The second transistor T2 is between a second node N2 and a third node N3. The second transistor T2 is turned on by a k-th control scan signal of the k-th control scan line CLk and connects the second node N2 and the third node N3. A gate electrode of the second transistor T2 may be connected to the k-th control scan line CLk, the first electrode may be connected to the third node N3, and the second electrode may be connected to the second node N2.

The third transistor T3 is between a first node N1 and the second node N2. The third transistor T3 is turned on by a k-th scan signal of the k-th scan line SLk and connects the first node N1 and the second node N2. A gate electrode of the third transistor T3 may be connected to the k-th scan line SLk, the first electrode may be connected to the second node N2, and the second electrode may be connected to the first node N1.

When both the second transistor T2 and the third transistor T3 are turned on, since the gate electrode and the second electrode of the first transistor T1 are connected, the first transistor T1 operates as a diode.

The first capacitor Cst is between the first node N1 and the initialization voltage line VIL. The first capacitor Cst may include a first capacitive electrode connected to the first node N1 and a second capacitive electrode connected to the initialization voltage line VIL.

The second capacitor Cpr is between the second node N2 and the j-th data line DLj. The second capacitor Cpr may include a first capacitive electrode connected to the second node N2 and a second capacitive electrode connected to the j-th data line DLj. A capacitance of the second capacitor Cpr may be larger than a capacitance of the first capacitor Cst.

When the first electrode of each of the first, second, and third transistors T1, T2, and T3 is a source electrode, the second electrode may be a drain electrode. Alternatively, when the first electrode of each of the first to third transistors T1, T2, and T3 is a drain electrode, the second electrode may be a source electrode.

An active layer of the first transistor T1, an active layer of the second transistor T2, and an active layer of the third transistor T3 may be formed of polysilicon, amorphous silicon, or an oxide semiconductor. Alternatively, some of the active layer of the first transistor T1, the active layer of the second transistor T2, and the active layer of the third transistor T3 may be formed of polysilicon, and the remainder thereof may be formed of an oxide semiconductor. For example, the active layer of the first transistor T1 may be formed of polysilicon, and the active layer of the second transistor T2 and the active layer of the third transistor T3 may be formed of an oxide semiconductor.

The first node N1 may be a point of contact of the gate electrode of the first transistor T1, the first capacitive electrode of the first capacitor Cst, and the second electrode of the third transistor T3. The second node N2 may be a point of contact of the second electrode of the second transistor T2, the first electrode of the third transistor T3, and the first capacitive electrode of the second capacitor Cpr. The third node N3 may be a point of contact between the second electrode of the first transistor T1 and the first electrode of the organic light emitting diode OLED.

According to the embodiment illustrated in FIG. 4, the subpixel PX includes the second transistor T2 between the second node N2 and the third node N3. Accordingly, since the second node N2 and the third node N3 may be separated by the second transistor T2, even when a leakage current that flows from the second driving voltage line VDL to the third node N3 via the first transistor T1 is generated while a data voltage of the j-th data line DLj is applied to the gate electrode (i.e., the first node N1) of the first transistor T1, the data voltage of the j-th data line DLj that is applied to the gate electrode of the first transistor T1 is not affected such that degradation in display quality may be it reduced or prevented.

Further, since the second capacitor Cpr is between the second node N2 and the j-th data line DLj, a decrease in luminance of the light emitting element due to a parasitic capacitor of an electrode overlapping the first node N1 may be reduced or prevented. Accordingly, it is possible to prevent or reduce degradation in display quality.

Figure 5:
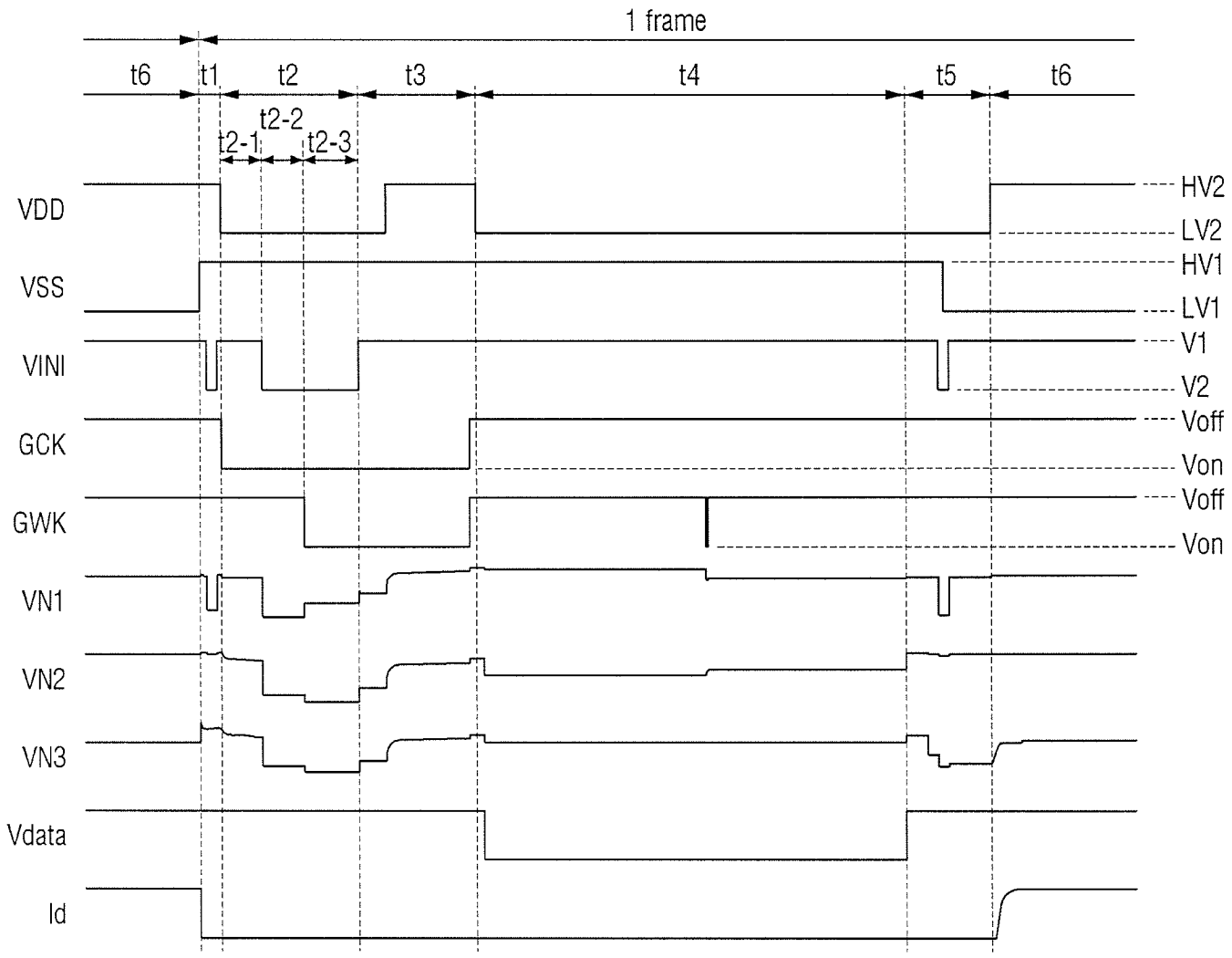
FIG. 5 illustrates a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in a light emitting element.

FIG. 5 is a waveform diagram showing a first driving voltage, a second driving voltage, an initialization voltage, a k-th scan signal, a k-th control signal, and a data voltage which are applied to the subpixel of FIG. 4, a gate voltage of a driving transistor of the subpixel, a voltage of a first node, a voltage of a third node, and a driving current flowing in a light emitting element.

Referring to FIG. 5, the first driving voltage VSS is a voltage applied to a cathode of the organic light emitting diode OLED, the second driving voltage VDD is a voltage applied to the first electrode of the first transistor T1, and the initialization voltage VINI is a voltage applied to the second capacitive electrode of the first capacitor Cst. A k-th scan signal GWk applied to the k-th scan line SLk is a signal for controlling turning-on and turning-off of the third transistor T3. A k-th control scan signal GCk applied to the k-th control scan line CLk is a signal for controlling turning-on and turning-off of the second transistor T2.

The first driving voltage VSS, the second driving voltage VDD, the initialization voltage VINI, the k-th scan signal GWk, and the k-th control scan signal GCk may be generated with a cycle of one frame period. The one frame period may include first to sixth periods t1 to t6. The first period t1 may be a period in which an on-bias is applied to the first transistor T1; the second period t2 may be an initialization period in which the first node N1 is initialized; the third period t3 may be a threshold voltage storage period in which the threshold voltage of the first transistor T1 is stored in the first capacitor Cst; the fourth period t4 may be a data voltage writing period in which the data voltage of the j-th data line DLj is written into the first node N1; the fifth period t5 may be an initialization period in which the third node N3 is initialized; and the sixth period t6 may be a light emission period in which the organic light emitting diode OLED emits light.

The subpixels PX of the display panel 100 simultaneously apply an on-bias to the first transistor T1, initialize the first node N1, and store the threshold voltage of the first transistor T1 in the first capacitor Cst during the first to third periods t1, t2, and t3. Then, the subpixels PX of the display panel 100 write the data voltage into the first node N1 sequentially for each scan line during the fourth period t4. Then, the subpixels PX of the display panel 100 simultaneously initialize the third node N3 during the fifth period t5 and simultaneously emit light using the organic light emitting diode OLED during the sixth period t6.

The first driving voltage VSS has a first high-level voltage HV1 during the first to fourth periods t1 to t4, is changed from the first high-level voltage HV1 to a first low-level voltage LV1 during the fifth period t5, and has the first low-level voltage LV1 during the sixth period t6. The second driving voltage VDD has a second high-level voltage HV2 during the first period t1, has a second low-level voltage LV2 during the second period t2, is changed from the second low-level voltage LV2 to the second high-level voltage HV2 during the third period t3, has the second low-level voltage LV2 during the fourth period t4 and the fifth period t5, and has the second high-level voltage HV2 during the sixth period t6. The initialization voltage VINI is changed from a first level voltage V1 to a second level voltage V2 and then changed from the second level voltage V2 to the first level voltage V1 during the first period t1, is changed from the first level voltage V1 to the second level voltage V2 during the second period t2, has the first level voltage V1 during the third period t3 and the fourth period t4, is changed from the first level voltage V1 to the second level voltage V2 and then changed from the second level voltage V2 to the first level voltage V1 during the fifth period t5, and has the first level voltage V1 during the sixth period t6.

The k-th scan signal GWk has a gate-off voltage Voff during the first period t1, is changed from the gate-off voltage Voff to a gate-on voltage Von during the second period t2, has the gate-on voltage Von during the third period t3, has a pulse having the gate-on voltage Von at least once during the fourth period t4, and has the gate-off voltage Voff during the fifth period t5 and the sixth period t6. The k-th control scan signal GCk may have the gate-off voltage Voff during the first period t1, have the gate-on voltage Von during the second period t2 and the third period t3, and have the gate-off voltage Voff during the fourth to sixth periods t4 to t6.

After the initialization voltage VINI is changed from the second level voltage V2 to the first level voltage V1 during the second period t2, the k-th scan signal GWk may be changed from the gate-off voltage Voff to the gate-on voltage Von. A pulse having the gate-on voltage Von may be generated during one horizontal period 1H during the fourth period t4. Alternatively, the pulse having the gate-on voltage Von of the k-th scan signal GWk in the fourth period t4 may overlap a pulse having the gate-on voltage Von of a (k−1)-th scan signal. In this case, the pulse having the gate-on voltage Von of the k-th scan signal GWk may be two horizontal periods 2H or more, and a period in which the pulse having the gate-on voltage Von of the k-th scan signal GWk does not overlap the pulse having the gate-on voltage Von of the (k−1)-th scan signal may be the one horizontal period 1H. The one horizontal period indicates a period in which a data voltage is supplied to each subpixel SP connected to any scan line of the display panel 100.

During the fourth period t4, n data voltages may be applied to the j-th data line DLj. The n data voltages may be applied by being synchronized with pulses having the gate-on voltage of n scan signals. For example, a k-th data voltage may be applied by being synchronized with a pulse having the gate-on voltage Von of the k-th scan signal GWk in the fourth period t4.

The first high-level voltage HV1 and the second high-level voltage HV2 may be substantially the same voltages. The first low-level voltage LV1 and the second low-level voltage LV2 may be substantially the same, or the first low-level voltage LV1 may be lower than the second low-level voltage LV2. The gate-on voltage Von corresponds to a voltage capable of turning on the first to third transistors T1, T2, and T3. The gate-off voltage Voff corresponds to a voltage capable of turning off the first to third transistors T1, T2, and T3.

FIGS. 6 to 11 are circuit diagrams showing operations of the subpixel during first to sixth periods of FIG. 5.

First, as illustrated in FIG. 5, during the first period t1, the first driving voltage VSS has the first high-level voltage HV1 and the second driving voltage VDD has the second high-level voltage HV2. During the first period t1, the initialization voltage VINI is changed from the first level voltage V1 to the second level voltage V2 and then changed from the second level voltage V2 to the first level voltage V1.

Figure 6:
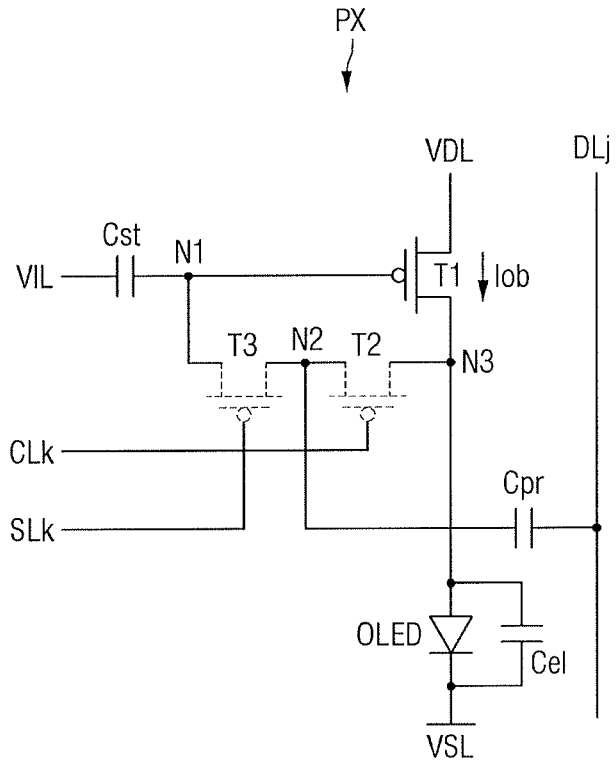
FIGS. 6 to 11 illustrate circuit diagrams showing operations of the subpixel during first to sixth periods of FIG. 5, respectively.

During the first period t1, the k-th scan signal GWk and the k-th control scan signal GCk have the gate-off voltage Voff. Thus, as illustrated in FIG. 6, during the first period t1, the second transistor T2 and the third transistor T3 are turned off.

During the first period t1, since the initialization voltage VINI is changed from the first level voltage V1 to the second level voltage V2, a change amount of the initialization voltage VINI may be reflected to the first node N1 by boosting of the first capacitor Cst. Therefore, a voltage VN1 of the first node N1 may be lowered. Thus, since a voltage difference between the gate electrode and the first electrode of the first transistor T1 becomes higher than the threshold voltage of the first transistor T1, the first transistor T1 may be turned on. That is, an on-bias may be applied to the first transistor T1. Since the on-bias is applied to the first transistor T1, when it is attempted to display a black luminance and then display a white luminance, the driving current Id of the first transistor T1 increases stepwise due to a hysteresis characteristic of the driving transistor DT such that it is possible to improve a stepwise increase of the luminance of the organic light emitting diode OLED.

Second, as illustrated in FIG. 5, the second period t2 may include a second-first period (t2-1), a second-second period (t2-2), and a second-third period (t2-3). The first driving voltage VSS has the high-level voltage HV1 during the second-first period (t2-1), the second-second period (t2-2), and the second-third period (t2-3). The second driving voltage VDD has the second low-level voltage VL2 during the second-first period (t2-1), the second-second period (t2-2), and the second-third period (t2-3). The initialization voltage VINI has the first level voltage V1 during the second-first period (t2-1) and has the second level voltage V2 during the second-second period (t2-2) and the second-third period (t2-3).

The k-th control scan signal GCk has the gate-off voltage Voff during the second-first period (t2-1), the second-second period (t2-2), and the second-third period (t2-3). The k-th scan signal GWk has the gate-off voltage Voff during the second-first period (t2-1) and the second-second period (t2-2) and has the gate-on voltage Von during the second-third period (t2-3). Thus, the second transistor T2 is turned on during the second-first period (t2-1), the second-second period (t2-2), and the second-third period (t2-3), and the third transistor T3 is turned on during the second-third period (t2-3).

Figure 7:
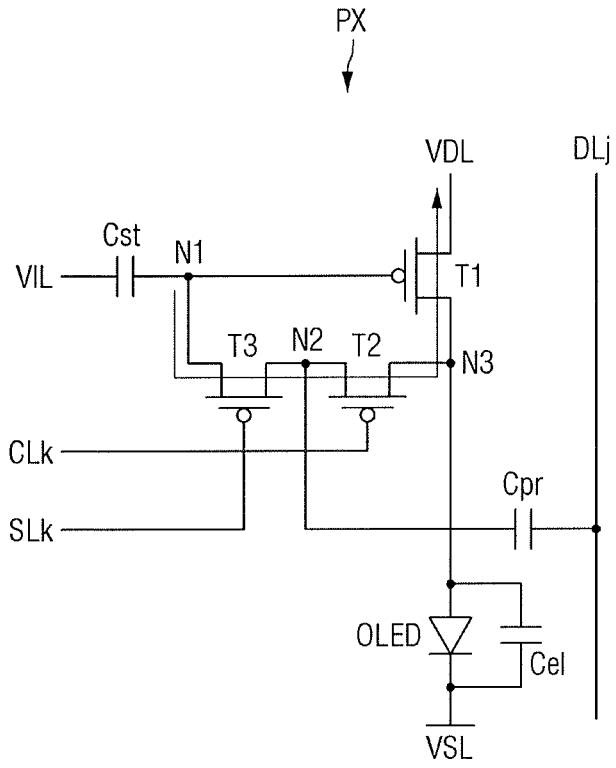

Since the initialization voltage VINI is changed from the first level voltage V1 to the second level voltage V2 as soon as the second-second period (t2-2) starts, the voltage VN1 of the first node N1 may be lowered by boosting of the first capacitor Cst. Also, since the second transistor T2 and the third transistor T3 are turned on during the second-third period (t2-3) as illustrated in FIG. 7, the voltage VN1 of the first node N1, a voltage VN2 of the second node N2, and a voltage VN3 of the third node N3 may be initialized.

Third, as illustrated in FIG. 5, during the third period t3, the first driving voltage VSS has the first high-level voltage HV1, the second driving voltage VDD is changed from the second low-level voltage LV2 to the first high-level voltage LV1, and the initialization voltage VINI has the first level voltage V1.

The k-th control scan signal GCk and the k-th scan signal GWk have the gate-on voltage Von during the third period t3. Thus, during the third period t3, the second transistor T2 and the third transistor T3 are turned on.

Figure 8:
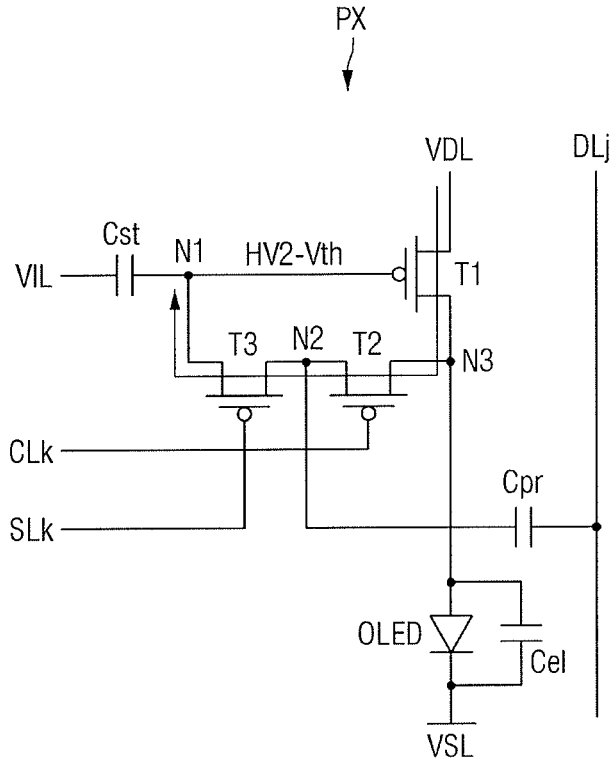

When the second transistor T2 and the third transistor T3 are turned on during the third period t3, since the gate electrode and the second electrode of the first transistor T1 are connected, the first transistor T1 operates as a diode. When the second driving voltage VDD is changed from the second low-level voltage LV2 to the second high-level voltage HV2 during the third period t3, the voltage between the gate electrode and the first electrode of the first transistor T1 becomes higher than the threshold voltage of the first transistor T1. Therefore, the first transistor T1 may form a current path until the voltage between the gate electrode and the first electrode reaches the threshold voltage of the first transistor T1. Accordingly, as illustrated in FIG. 8, in the first transistor T1, a voltage of the gate electrode, i.e., the voltage VN1 of the first node N1, may rise up to a voltage difference (HV2−Vth) between the second high-level voltage HV2 of the second driving voltage VDD and the threshold voltage Vth of the first transistor T1. The voltage difference (HV2−Vth) between the second high-level voltage HV2 and the threshold voltage Vth of the first transistor T1 may be stored in the first capacitor Cst.

Fourth, as illustrated in FIG. 5, during the fourth period t4, the first driving voltage VSS has the first high-level voltage HV1, the second driving voltage VDD has the second low-level voltage LV2, and the initialization voltage VINI has the first level voltage V1.

The k-th control scan signal GCk has the gate-off voltage Voff during the fourth period t4. The k-th scan signal GWk has a pulse having the gate-on voltage Von at least once during the fourth period t4. Thus, during the fourth period t4, the second transistor T2 is turned off, and the third transistor T3 is turned on due to the pulse having the gate-on voltage Von at least once.

Figure 9:
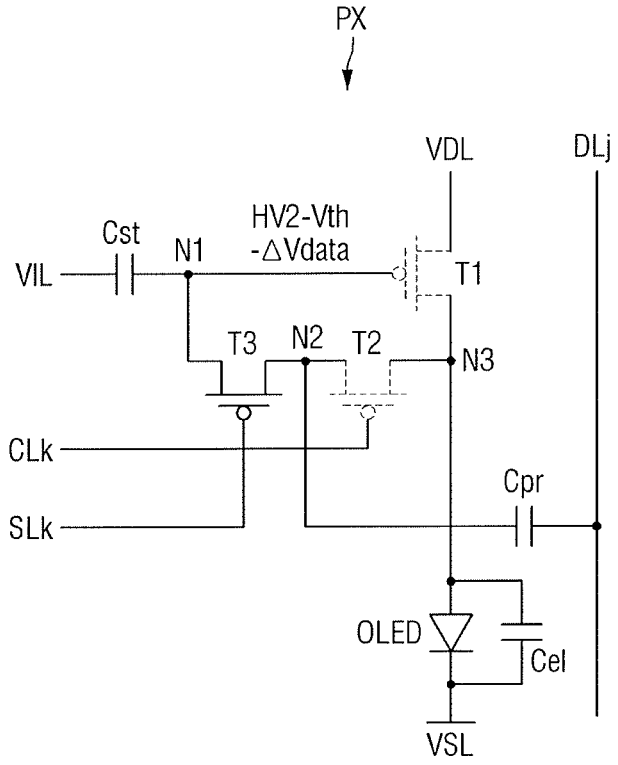

When the third transistor T3 is turned on during the fourth period t4, the first node N1 may be electrically connected to the first capacitive electrode of the second capacitor Cpr. Thus, a change amount ΔVdata of the data voltage of the j-th data line DLj may be reflected to the first node N1 by boosting of the second capacitor Cpr. Therefore, as illustrated in FIG. 9, during the fourth period t4, the voltage VN1 of the first node N1 may be changed to "HV2−Vth−ΔVdata," Thus, since a voltage difference between the gate electrode and the first electrode of the first transistor T1 becomes less than the threshold voltage of the first transistor T1, the first transistor T1 may be turned off. Meanwhile, due to the first capacitor Cst, the change amount ΔVdata of the data voltage of the j-th data line DLj that is reflected to the first node N1 due to the second capacitor Cpr may be smaller than a change amount of a data voltage of the j-th data line DLj.

Fifth, as illustrated in FIG. 5, during the fifth period t5, the first driving voltage VSS is changed from the first high-level voltage HV1 to the first low-level voltage LV1, the second driving voltage VDD has the second low-level voltage LV2, and the initialization voltage VINI is changed from the first level voltage V1 to the second level voltage V2 and then changed from the second level voltage V2 to the first level voltage V1. The first driving voltage VSS may be changed from the first high-level voltage HV1 to the first low-level voltage LV1 during the period in which the initialization voltage VINI has the second level voltage V2.

The k-th control scan signal GCk and the k-th scan signal GWk have the gate-off voltage Voff during the fourth period t4. Thus, the second transistor T2 and the third transistor T3 are turned off during the fourth period t4.

Since the initialization voltage VINI is changed from the first level voltage V1 to the second level voltage V2 during the fifth period t5, a change amount of the initialization voltage VINI may be reflected to the first node N1 by boosting of the first capacitor Cst. Therefore, the voltage VN1 of the first node N1 may be lowered to "HV2−Vth−ΔVdata−ΔVINI." Thus, since a voltage difference between the gate electrode and the first electrode of the first transistor T1 becomes higher than the threshold voltage of the first transistor T1, the first transistor T1 may be turned on. Due to the first transistor T1 being turned on, as illustrated in FIG. 10, the third node N3 may be initialized to the second low-level voltage LV2 of the second driving voltage VDD.

When, during the fifth period t5, the initialization voltage VINI is changed from the second level voltage V2 to the first level voltage V1, and then the first driving voltage VSS is changed from the first high-level voltage HV1 to the first low-level voltage LV1, the change amount of the first driving voltage VSS may be reflected to the third node N3 due to the parasitic capacitance Cel of the organic light emitting diode OLED. In this case, since the voltage of the third node N3 is lowered, when the organic light emitting diode OLED emits light with a low-gradation luminance, the time taken for charging the parasitic capacitance Cel of the organic light emitting diode OLED may be increased because the driving current Id is small. Therefore, during the sixth period t6, light emission of the organic light emitting diode OLED may be delayed, and a low-gradation stain may occur due to the pixel PX failing to express a gradation attempted to be expressed.

Figure 10:
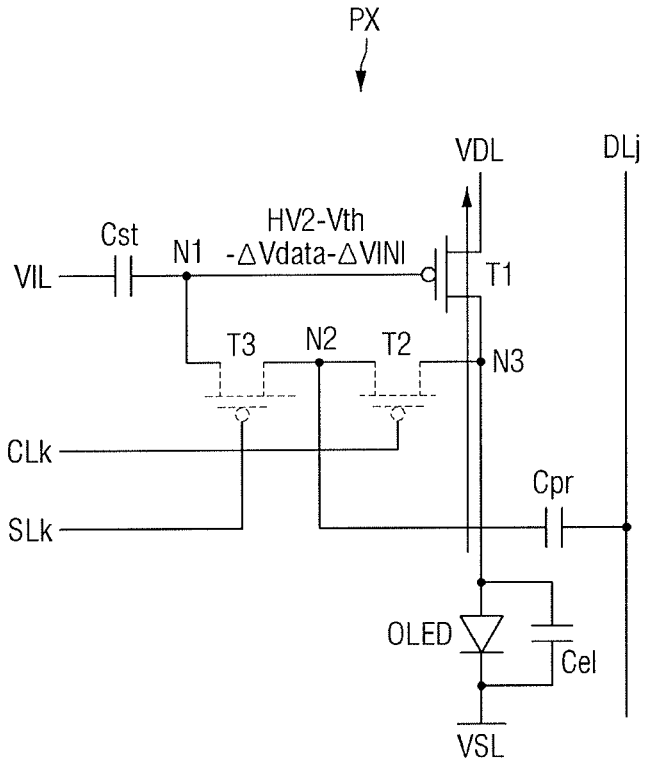

According to the embodiment illustrated in FIGS. 5 and 10, when, during the fifth period t5, the first driving voltage VSS is changed from the first high-level voltage HV1 to the first low-level voltage LV1 during the period in which the initialization voltage VINI has the second level voltage V2, it is possible to prevent the change amount of the first driving voltage VSS from being reflected to the third node N3 due to the parasitic capacitance Cel of the organic light emitting diode OLED. In this case, since it is possible to prevent the voltage of the third node N3 from being lowered, even when the organic light emitting diode OLED emits light with a low-gradation luminance and thus the driving current Id is small, the time taken for charging the parasitic capacitance Cel of the organic light emitting diode OLED may be reduced. Therefore, since delay of a light emitting time point of the organic light emitting diode OLED in the sixth period t6 may be improved, degradation in image quality, e.g., a low-gradation stain, may be prevented or reduced.

Also, the second low-level voltage LV2 of the second driving voltage VDD may be higher than the first low-level voltage LV1 of the first driving voltage VSS. In this case, even when the organic light emitting diode OLED emits light with a low-gradation luminance, the driving current Id is small during the sixth period t6. Thus, the time taken for charging the parasitic capacitance Cel of the organic light emitting diode OLED may be reduced. Therefore, since it is possible to advance a light emitting time point of the organic light emitting diode OLED in the sixth period t6, degradation in image quality, e.g., a low-gradation stain, may be prevented or reduced.

Sixth, as illustrated in FIG. 5, during the sixth period t6, the first driving voltage VSS has the first low-level voltage LV1, the second driving voltage VDD has the second high-level voltage HV2, and the initialization voltage VINI has the first level voltage V1.

The k-th control scan signal GCk and the k-th scan signal GWk have the gate-off voltage Voff during the sixth period t6. Thus, the second transistor T2 and the third transistor T3 are turned off during the sixth period t6.

Figure 11:
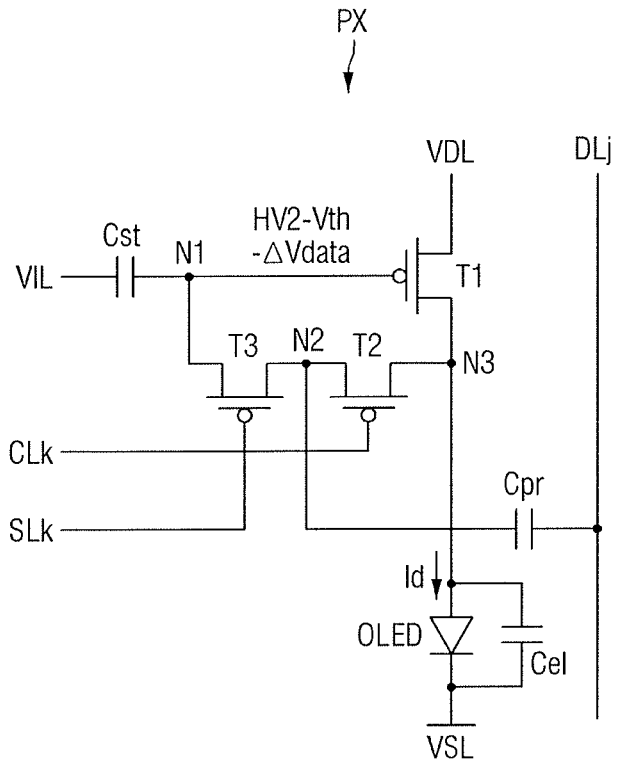

As illustrated in FIG. 11, during the sixth period t6, the driving current Id of the first transistor T1 may flow to the organic light emitting diode OLED according to the voltage (HV2−Vth−ΔVdata) of the first node N1. The driving current Id of the first transistor T1 may be defined as Equation 2 below.

$$ID=k'\times(HV2-(HV2-Vth-\Delta V\text{data})-Vth)^2 \quad \text{[Equation 2]}$$

When Equation 2 is simplified, Equation 3 is derived.

$$ID=k'\times\Delta V\text{data}^2 \quad \text{[Equation 3]}$$

As in Equation 3, the driving current Id does not depend on the threshold voltage Vth of the first transistor T1. That is, the threshold voltage Vth of the first transistor T1 is compensated for.

According to the embodiment illustrated in FIGS. 6 to 11, since, in the fifth period t5, the first driving voltage VSS is changed from the first high-level voltage HV1 to the first low-level voltage LV1 during the period in which the initialization voltage VINI has the second level voltage V2, the change amount of the first driving voltage VSS may be prevented from being reflected to the third node N3 due to the parasitic capacitance Cel of the organic light emitting diode OLED. Therefore, since it is possible to prevent the voltage of the third node N3 from being lowered, even when the organic light emitting diode OLED emits light with a low-gradation luminance. Thus, the driving current Id is small during the sixth period t6 and the time taken for charging the parasitic capacitance Cel of the organic light emitting diode OLED may be reduced. Therefore, since it is possible to advance a light emitting time point of the organic light emitting diode OLED in the sixth period t6, degradation in image quality, e.g., a low-gradation stain, may be prevented or reduced.

Also, according to the embodiment illustrated in FIGS. 6 to 11, the second low-level voltage LV2 of the second driving voltage VDD may be higher than the first low-level voltage LV1 of the first driving voltage VSS. In this case, even when the organic light emitting diode OLED emits light with a low-gradation luminance and thus the driving current Id is small during the sixth period t6, the time taken for charging the parasitic capacitance Cel of the organic light emitting diode OLED may be reduced. Therefore, since it is possible to advance a light emitting time point of the organic light emitting diode OLED in the sixth period t6, degradation in image quality, e.g., a low-gradation stain, may be prevented or reduced.

Also, according to the embodiment illustrated in FIGS. 6 to 11, since an on-bias is applied to the first transistor T1 during the first period t1, when it is attempted to display a black luminance and then display a white luminance, the driving current Id of the first transistor T1 increases stepwise due to the hysteresis characteristic of the driving transistor DT such that it is possible to improve a stepwise increase of the luminance of the organic light emitting diode OLED.

Further, according to the embodiment illustrated in FIGS. 6 to 11, since the threshold voltage Vth of the first transistor T1 is stored in the first capacitor Cst during the third period t3, the driving current Id in which the threshold voltage Vth of the first transistor T1 is compensated for may flow to the organic light emitting diode OLED during the sixth period t6.

Figure 12:
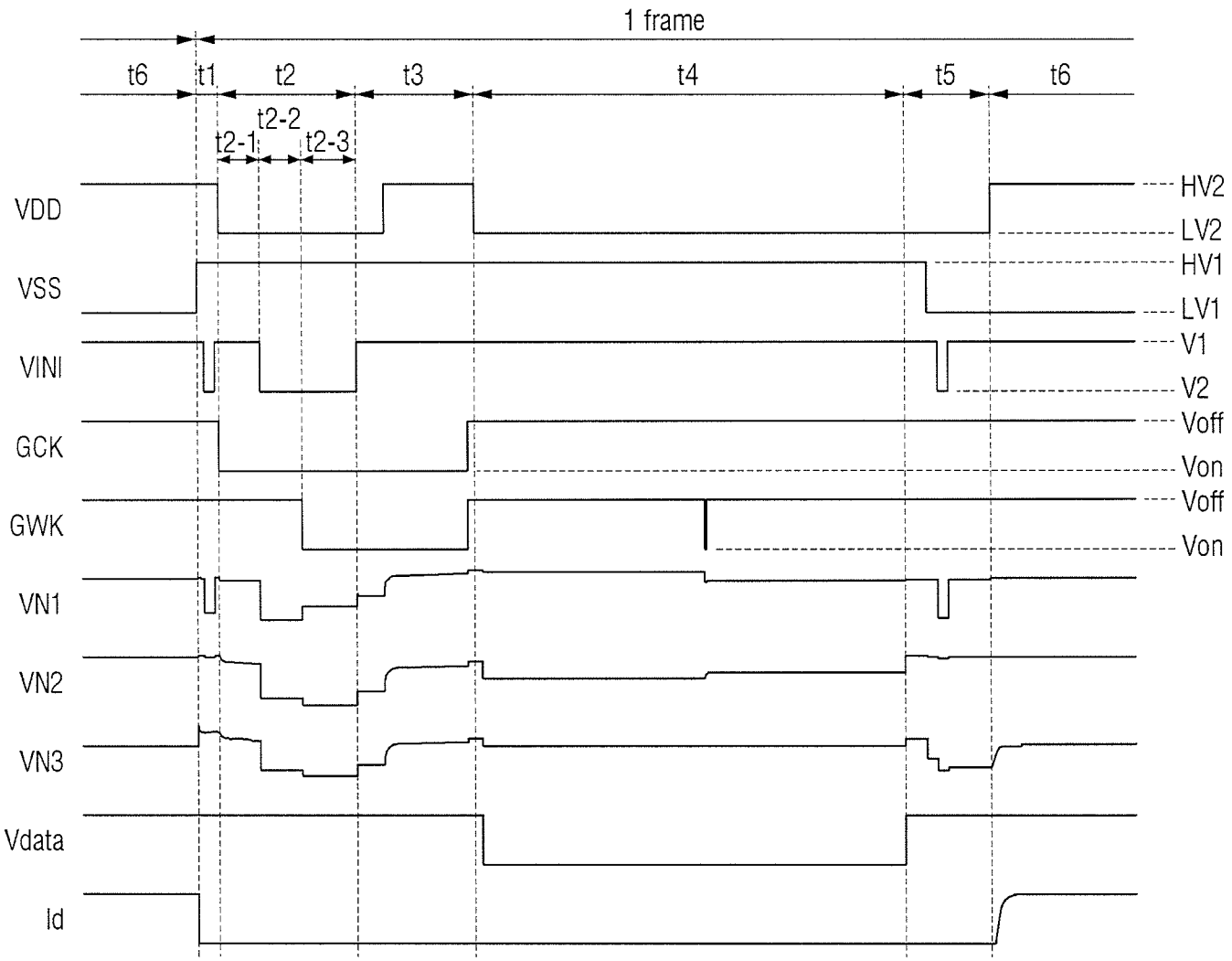
FIG. 12 illustrates a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in the light emitting element.

FIG. 12 is a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in the light emitting element.

The embodiment illustrated in FIG. 12 is different from the embodiment illustrated in FIG. 5 only in that, during the fifth period t5, the first driving voltage VSS is changed from the first high-level voltage HV1 to the first low-level voltage LV1 before the initialization voltage VINI is changed from the first level voltage V1 to the second level voltage V2.

According to the embodiment illustrated in FIG. 12, since, during the fifth period t5, the first driving voltage VSS is changed from the first high-level voltage HV1 to the first low-level voltage LV1 before the initialization voltage VINI is changed from the first level voltage V1 to the second level voltage V2, the change amount of the first driving voltage VSS may be prevented from being reflected to the third node N3 due to the parasitic capacitance Cel of the organic light emitting diode OLED. Therefore, since it is possible to prevent the voltage of the third node N3 from being lowered, even when the organic light emitting diode OLED emits light with a low-gradation luminance and thus the driving current Id is small during the sixth period t6, the time taken for charging the parasitic capacitance Cel of the organic light emitting diode OLED may be reduced. Therefore, since it is possible to advance a light emitting time point of the organic light emitting diode OLED in the sixth period t6, degradation in image quality, e.g., a low-gradation stain, may be prevented or reduced.

Figure 13:
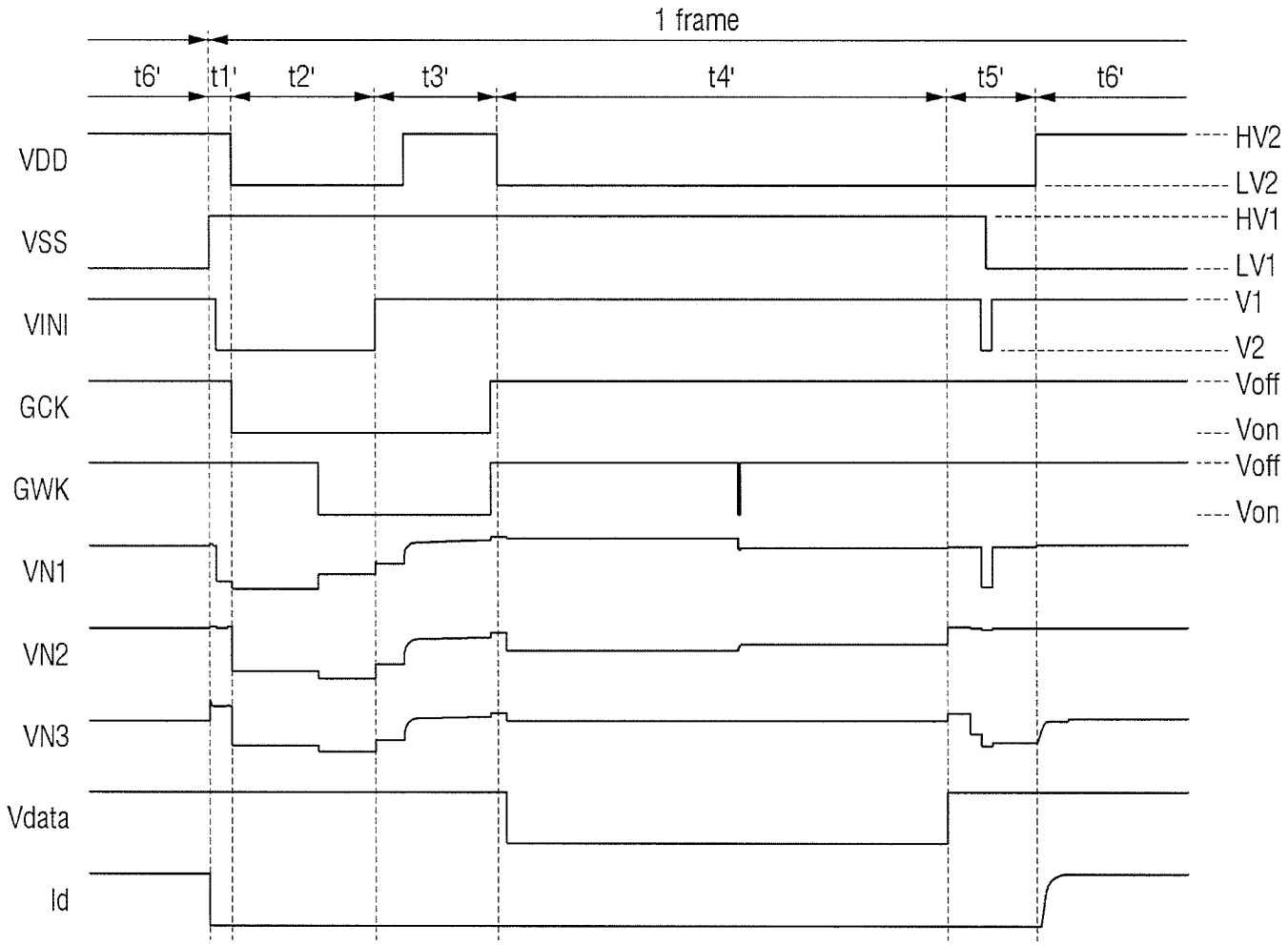
FIG. 13 illustrates a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in the light emitting element.

FIG. 13 is a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in the light emitting element.

The embodiment illustrated in FIG. 13 is different from the embodiment illustrated in FIG. 5 only in that the initialization voltage VINI has the second level voltage V2 during the second period t2. According to the embodiment illustrated in FIG. 13, since the number of times in which the initialization voltage VINI is changed between the first level voltage V1 and the second level voltage V2 is reduced, power consumption may be saved.

Figure 14:
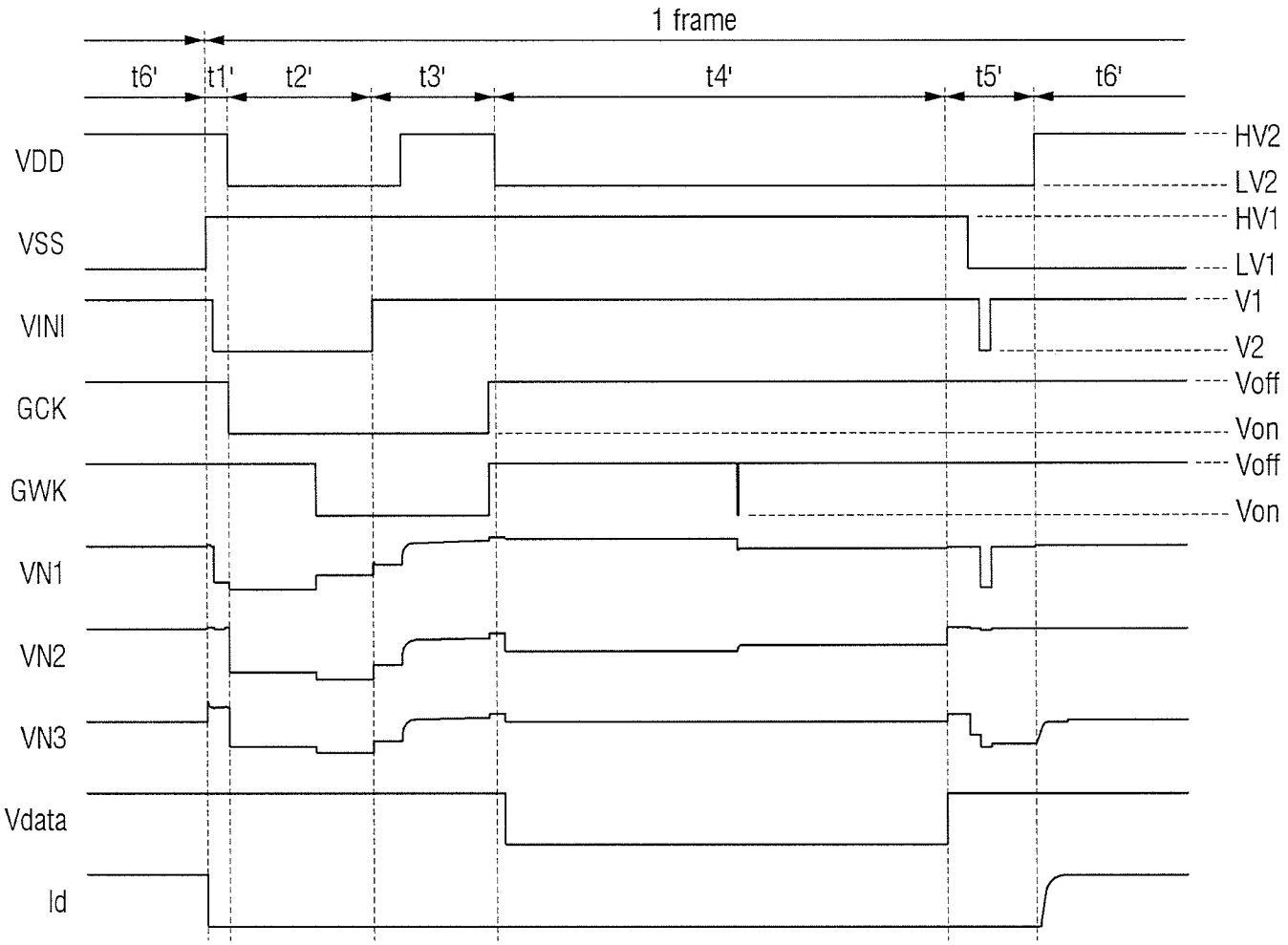
FIG. 14 illustrates a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in the light emitting element.

FIG. 14 is a waveform diagram showing a first driving voltage, a second driving voltage, a k-th scan signal, a k-th control signal, an initialization voltage, and a data voltage which are applied to the subpixel of FIG. 4, a gate voltage of a driving transistor of the subpixel, a voltage of a first node, a voltage of a third node, and a driving current flowing in the light emitting element.

The embodiment illustrated in FIG. 14 is different from the embodiment illustrated in FIG. 12 only in that the initialization voltage VINI has the second level voltage V2 during the second period t2. According to the embodiment illustrated in FIG. 14, since the number of times in which the initialization voltage VINI is changed between the first level voltage V1 and the second level voltage V2 is reduced, power consumption may be saved.

Figure 15:
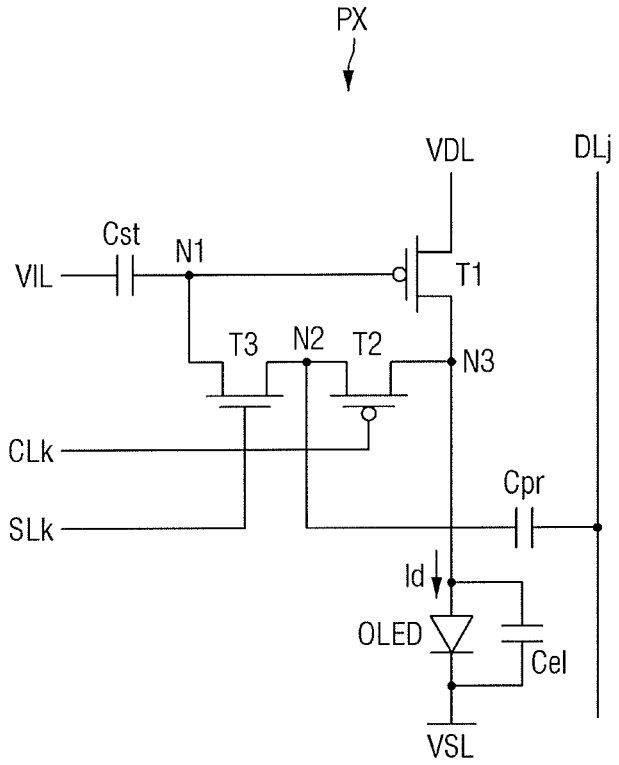
FIG. 15 illustrates a circuit diagram specifically showing an example of the subpixel according to an embodiment.

FIG. 15 is a circuit diagram specifically showing an example of the subpixel according to an embodiment. The embodiment illustrated in FIG. 15 is different from the embodiment illustrated in FIG. 4 in that the first transistor T1 and the second transistor T2 are formed as PMOS transistors and the third transistor T3 is formed as an NMOS transistor. The PMOS transistor is turned on by a gate-on voltage which is lower than a gate-off voltage, and the NMOS transistor is turned on by a gate-on voltage which is higher than a gate-off voltage. An active layer of the third transistor T3 formed as the NMOS transistor may be formed of an oxide semiconductor. Active layers of the first transistor T1 and the second transistor T2 which are formed as the PMOS transistors may be formed of polysilicon.

For the subpixel PX according to the embodiment illustrated in FIG. 15 to operate, the k-th scan signal GWk which is applied to the gate electrode of the third transistor T3 in FIGS. 5 and 12 to 14 has to be modified corresponding to characteristics of the NMOS transistor. The k-th scan signal GWk may have a waveform in which the k-th scan signal GWk illustrated in FIGS. 5 and 12 to 14 is reversed. For example, the k-th scan signal GWk may have a gate-on voltage Von which has a voltage higher than a gate-off voltage Voff during the second period t2 and the third period t3 and have a pulse having a gate-on voltage Von which has a voltage higher than a gate-off voltage Voff during the fourth period t4.

Figure 16:
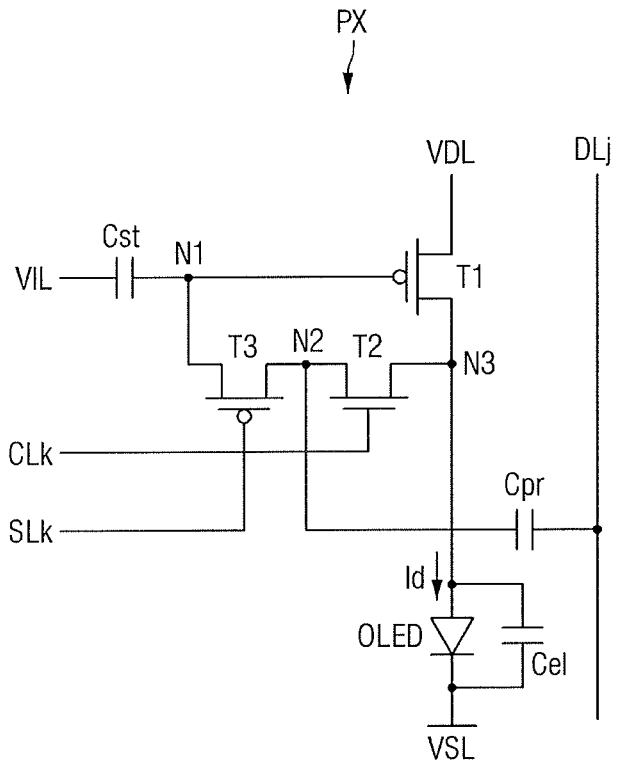
FIG. 16 illustrates a circuit diagram specifically showing an example of the subpixel according to an embodiment.

FIG. 16 is a circuit diagram specifically showing an example of the subpixel according to an embodiment. The embodiment illustrated in FIG. 16 is different from the embodiment illustrated in FIG. 4 in that the first transistor T1 and the third transistor T3 are formed as PMOS transistors and the second transistor T2 is formed as an NMOS transistor. An active layer of the second transistor T2 formed as the NMOS transistor may be formed of an oxide semiconductor. Active layers of the first transistor T1 and the third transistor T3 which are formed as the PMOS transistors may be formed of polysilicon.

For the subpixel PX according to the embodiment illustrated in FIG. 16 to operate, the k-th control scan signal GCk which is applied to the gate electrode of the second transistor T2 in FIGS. 5 and 12 to 14 has to be modified corresponding to characteristics of the NMOS transistor. The k-th control scan signal GCk may have a waveform in which the k-th control scan signal GCk illustrated in FIGS. 5 and 12 to 14 is reversed. For example, the k-th control scan signal GCk may have a gate-on voltage Von which has a voltage higher than a gate-off voltage Voff during the second period t2 and the third period t3.

Figure 17:
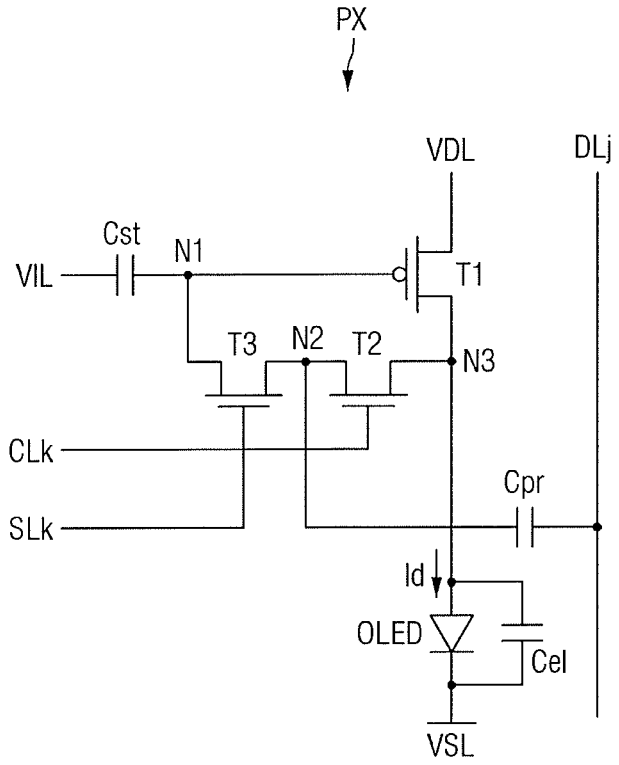
FIG. 17 illustrates a circuit diagram specifically showing an example of the subpixel according to an embodiment.

FIG. 17 is a circuit diagram specifically showing an example of the subpixel according to an embodiment. The embodiment illustrated in FIG. 17 is different from the embodiment illustrated in FIG. 4 in that the first transistor T1 is formed as a PMOS transistor and the second transistor T2 and the third transistor T3 are formed as NMOS transistors. Active layers of the second transistor T2 and the third transistor T3 which are formed as the NMOS transistors may be formed of an oxide semiconductor. An active layer of the first transistor T1 formed as the PMOS transistor may be formed of polysilicon.

For the subpixel PX according to the embodiment illustrated in FIG. 17 to operate, the k-th scan signal GWk applied to the gate electrode of the third transistor T3 and the k-th control scan signal GCk applied to the gate electrode of the second transistor T2 in FIGS. 5 and 12 to 14 have to be modified corresponding to characteristics of the NMOS transistor. The k-th scan signal GWk may have a waveform in which the k-th scan signal GWk illustrated in FIGS. 5 and 12 to 14 is reversed. The k-th control scan signal GCk may have a waveform in which the k-th control scan signal GCk illustrated in FIGS. 5 and 12 to 14 is reversed. For example, the k-th scan signal GWk may have a gate-on voltage Von which has a voltage higher than a gate-off voltage Voff during the second period t2 and the third period t3 and have a pulse having a gate-on voltage Von which has a voltage higher than a gate-off voltage Voff during the fourth period t4. The k-th control scan signal GCk may have a gate-on voltage Von which has a voltage higher than a gate-off voltage Voff during the second period t2 and the third period t3.

Figure 18:
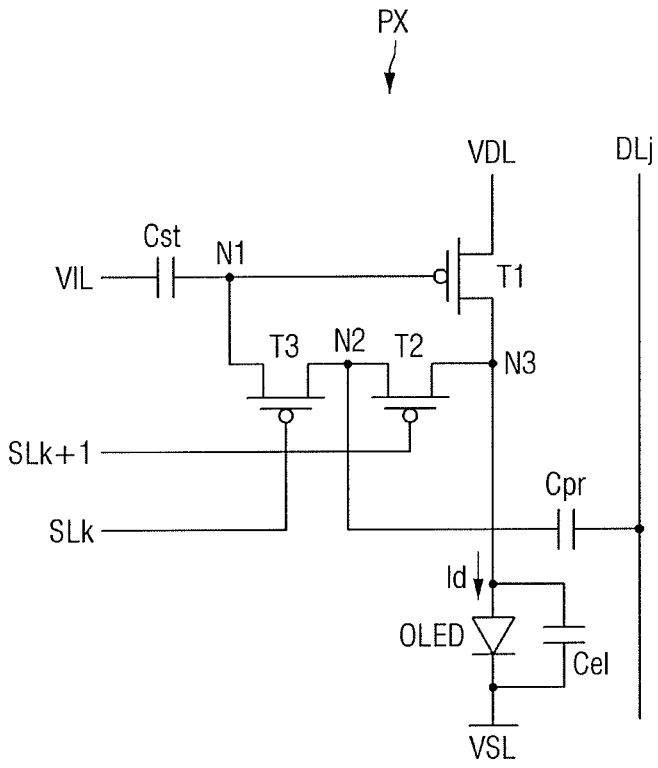
FIG. 18 illustrates a circuit diagram specifically showing an example of the subpixel according to an embodiment.

FIG. 18 is a circuit diagram specifically showing an example of the subpixel according to an embodiment. The embodiment illustrated in FIG. 18 is different from the embodiment illustrated in FIG. 4 in that the gate electrode of the second transistor T2 is connected to a (k+1)-th scan line (SLk+1) instead of the k-th control scan line CLk. The (k+1)-th scan line (SLk+1) may be substantially the same as the k-th scan line SLk during the first to third periods t1, t2, and t3 and the fifth and sixth periods t5 and t6 that is illustrated in FIGS. 5 and 12 to 14. The (k+1)-th scan line (SLk+1) may have a pulse having the gate-on voltage Von at least once during the fourth period t4. The pulse having the gate-on voltage Von of the (k+1)-th scan line (SLk+1) may be generated later than a pulse having the gate-on voltage Von of the k-th scan line SLk.

Figure 19:
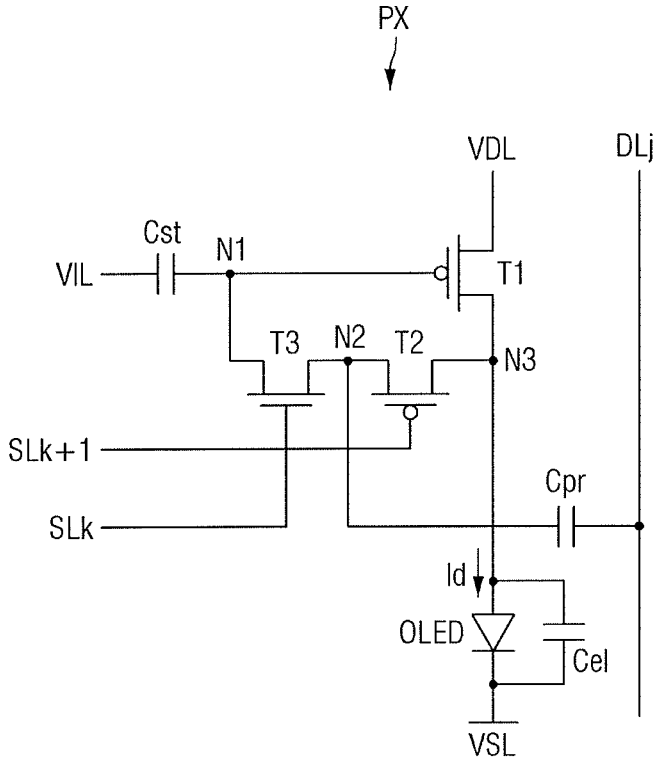
FIG. 19 illustrates a circuit diagram specifically showing an example of the subpixel according to an embodiment.

FIG. 19 is a circuit diagram specifically showing an example of the subpixel according to an embodiment. The embodiment illustrated in FIG. 19 is different from the embodiment illustrated in FIG. 15 in that the gate electrode of the second transistor T2 is connected to the (k+1)-th scan line (SLk+1) instead of the k-th control scan line CLk.

Figure 20:
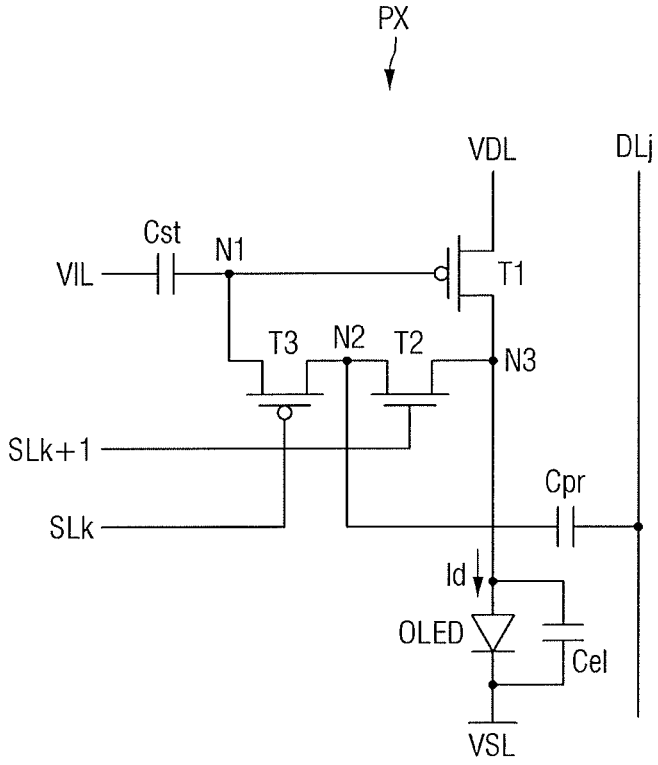
FIG. 20 illustrates a circuit diagram specifically showing an example of the subpixel according to an embodiment.

FIG. 20 is a circuit diagram specifically showing an example of the subpixel according to an embodiment. The embodiment illustrated in FIG. 20 is different from the embodiment illustrated in FIG. 16 in that the gate electrode of the second transistor T2 is connected to the (k+1)-th scan line (SLk+1) instead of the k-th control scan line CLk.

Figure 21:
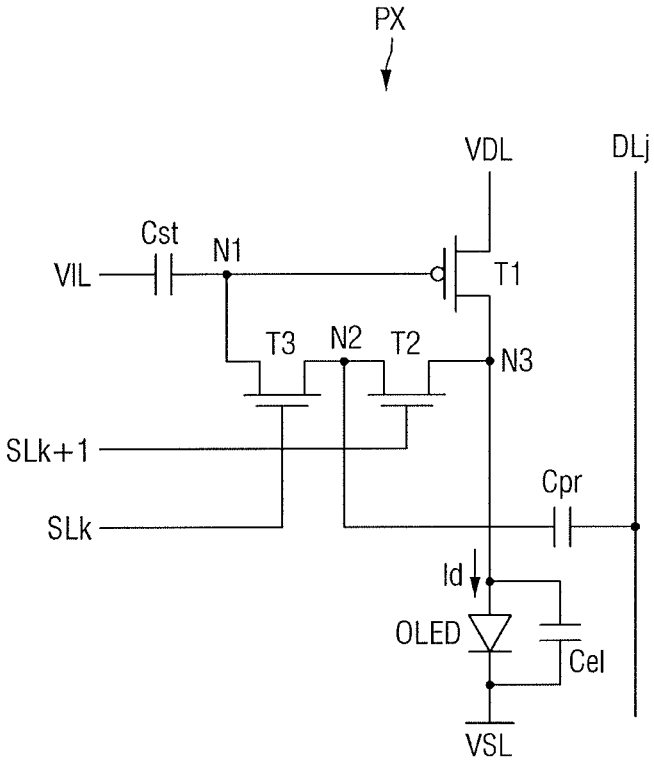
FIG. 21 illustrates a circuit diagram specifically showing an example of the subpixel according to an embodiment.

FIG. 21 is a circuit diagram specifically showing an example of the subpixel according to an embodiment. The embodiment illustrated in FIG. 21 is different from the embodiment illustrated in FIG. 17 in that the gate electrode of the second transistor T2 is connected to the (k+1)-th scan line (SLk+1) instead of the k-th control scan line CLk.

Figure 22:
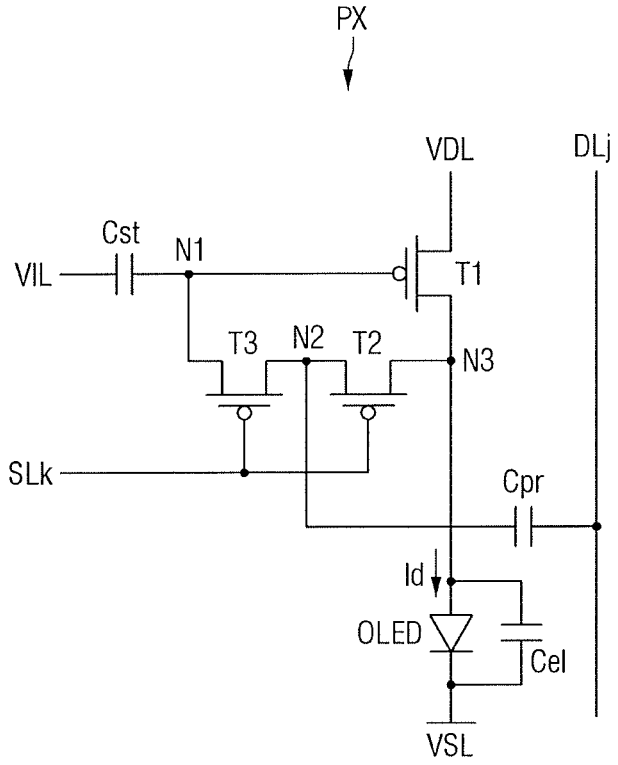
FIG. 22 illustrates a circuit diagram specifically showing an example of the subpixel according to an embodiment.

FIG. 22 is a circuit diagram specifically showing an example of the subpixel according to an embodiment. The embodiment illustrated in FIG. 22 is different from the embodiment illustrated in FIG. 4 in that the gate electrode of the second transistor T2 is connected to the k-th scan line SLk instead of the k-th control scan line CLk.

Figure 23:
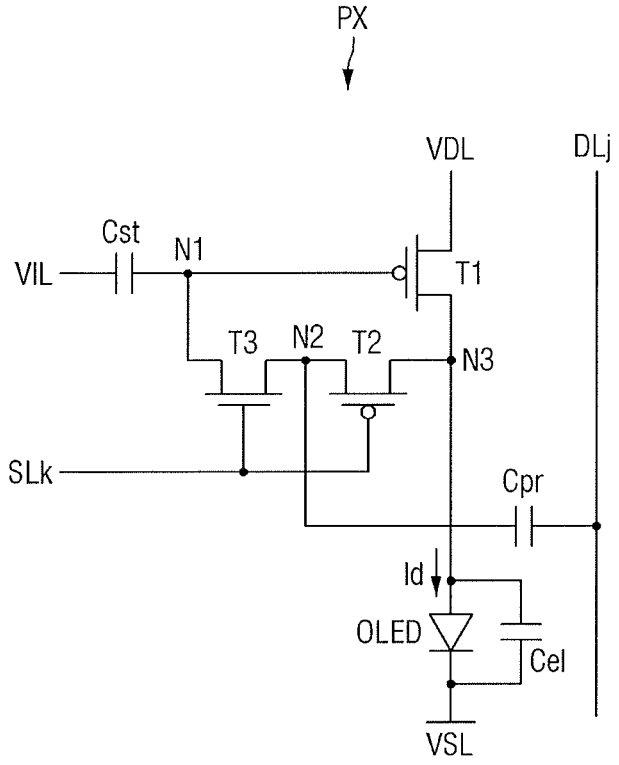
FIG. 23 illustrates a circuit diagram specifically showing an example of the subpixel according to an embodiment.

FIG. 23 is a circuit diagram specifically showing an example of the subpixel according to an embodiment. The embodiment illustrated in FIG. 23 is different from the embodiment illustrated in FIG. 15 in that the gate electrode of the second transistor T2 is connected to the k-th scan line SLk instead of the k-th control scan line CLk.

Figure 24:
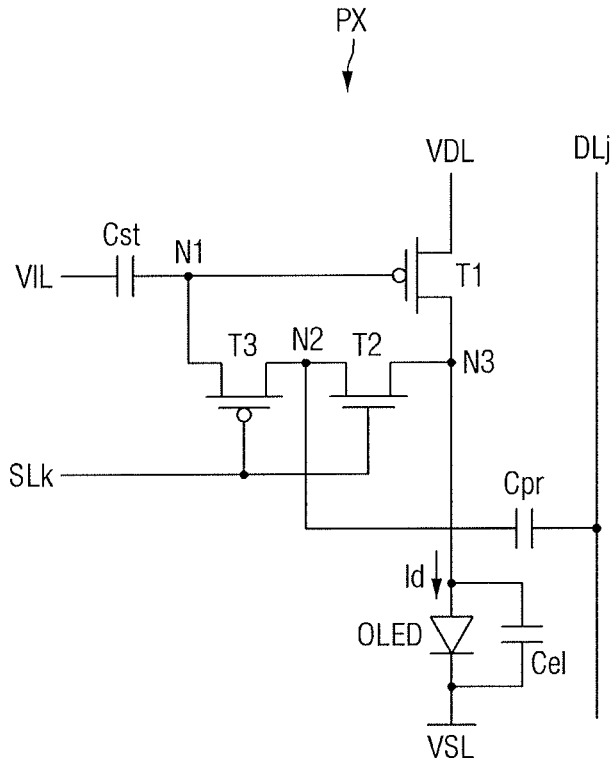
FIG. 24 illustrates a circuit diagram specifically showing an example of the subpixel according to an embodiment.

FIG. 24 is a circuit diagram specifically showing an example of the subpixel according to an embodiment. The embodiment illustrated in FIG. 24 is different from the embodiment illustrated in FIG. 16 in that the gate electrode of the second transistor T2 is connected to the k-th scan line SLk instead of the k-th control scan line CLk.

Figure 25:
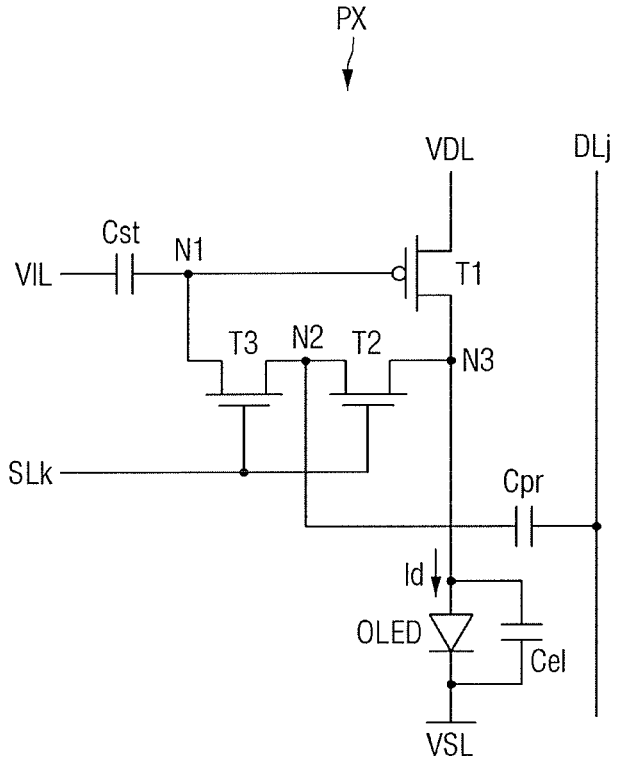
FIG. 25 illustrates a circuit diagram specifically showing an example of the subpixel according to an embodiment.

FIG. 25 is a circuit diagram specifically showing an example of the subpixel according to an embodiment. The embodiment illustrated in FIG. 25 is different from the embodiment illustrated in FIG. 17 in that the gate electrode of the second transistor T2 is connected to the k-th scan line SLk instead of the k-th control scan line CLk.

Figure 26:
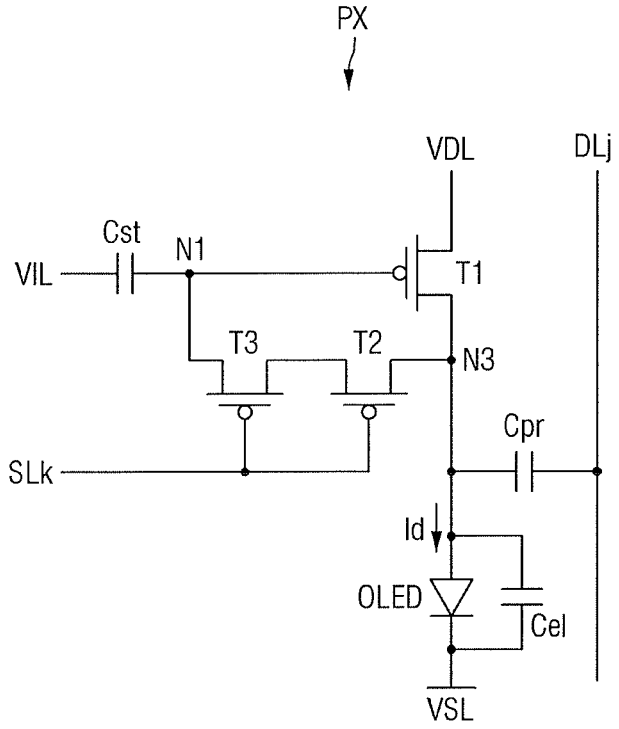
FIG. 26 illustrates a circuit diagram specifically showing an example of the subpixel according to an embodiment.

FIG. 26 is a circuit diagram specifically showing an example of the subpixel according to an embodiment. The embodiment illustrated in FIG. 26 is different from the embodiment illustrated in FIG. 22 in that the second capacitor Cpr is between the third node N3 and the j-th data line DLj. In FIG. 26, the second capacitor Cpr may include a first capacitive electrode connected to the third node N3 and a second capacitive electrode connected to the j-th data line DLj.

Figure 27:
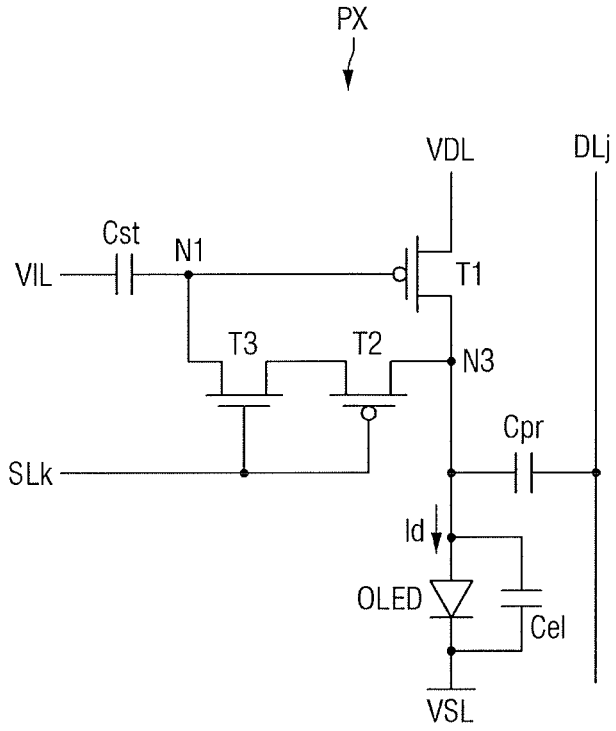
FIG. 27 illustrates a circuit diagram specifically showing an example of the subpixel according to an embodiment.

FIG. 27 is a circuit diagram specifically showing an example of the subpixel according to an embodiment. The embodiment illustrated in FIG. 27 is different from the embodiment illustrated in FIG. 23 in that the second capacitor Cpr is between the third node N3 and the j-th data line DLj. In FIG. 27, the second capacitor Cpr may include a first capacitive electrode connected to the third node N3 and a second capacitive electrode connected to the j-th data line DLj.

Figure 28:
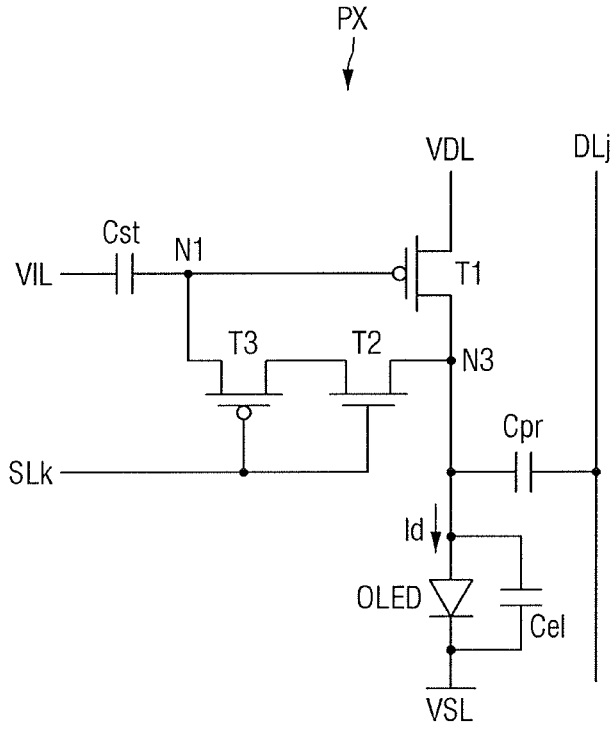
FIG. 28 illustrates a circuit diagram specifically showing an example of the subpixel according to an embodiment.

FIG. 28 is a circuit diagram specifically showing an example of the subpixel according to an embodiment. The embodiment illustrated in FIG. 28 is different from the embodiment illustrated in FIG. 24 in that the second capacitor Cpr is between the third node N3 and the j-th data line DLj. In FIG. 28, the second capacitor Cpr may include a first capacitive electrode connected to the third node N3 and a second capacitive electrode connected to the j-th data line DLj.

Figure 29:
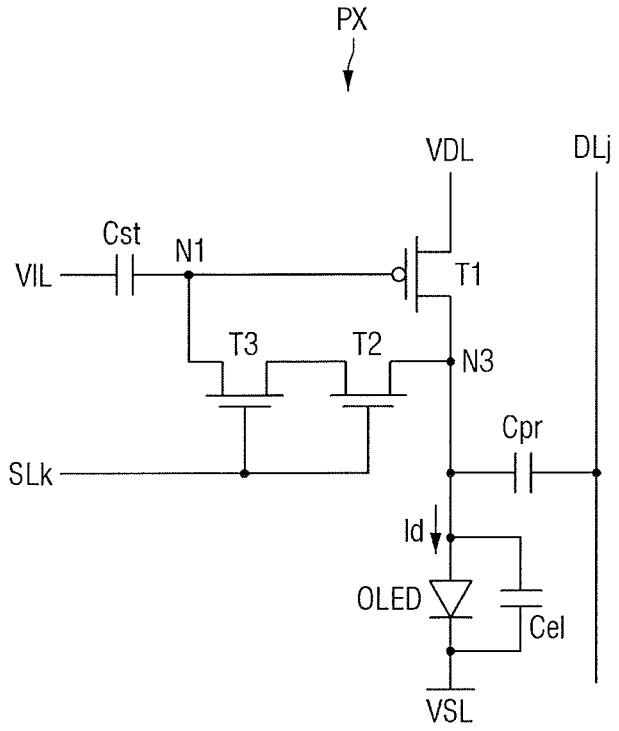
FIG. 29 illustrates a circuit diagram specifically showing an example of the subpixel according to an embodiment.

FIG. 29 is a circuit diagram specifically showing an example of the subpixel according to an embodiment. The embodiment illustrated in FIG. 29 is different from the embodiment illustrated in FIG. 25 in that the second capacitor Cpr is between the third node N3 and the j-th data line DLj. In FIG. 29, the second capacitor Cpr may include a first capacitive electrode connected to the third node N3 and a second capacitive electrode connected to the j-th data line DLj.

Figure 30:
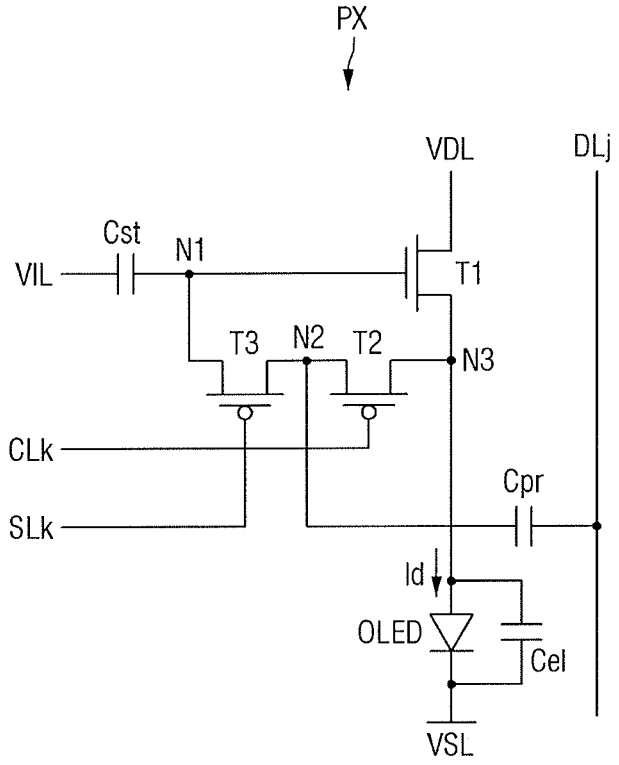
FIG. 30 illustrates a circuit diagram specifically showing an example of the subpixel according to an embodiment.

FIG. 30 is a circuit diagram specifically showing an example of the subpixel according to an embodiment. The embodiment illustrated in FIG. 30 is different from the embodiment illustrated in FIG. 4 in that the first transistor T1 is formed as an NMOS transistor. The NMOS transistor is turned on due to a gate-on voltage higher than a gate-off voltage. An active layer of the first transistor T1 formed as the NMOS transistor may be formed of an oxide semiconductor.

For the subpixel PX according to the embodiment illustrated in FIG. 30 to operate, the initialization voltage VINI and the data voltage Vdata which are applied to the gate electrode of the first transistor T1 in FIGS. 5 and 12 to 14 have to be modified corresponding to the characteristics of the NMOS transistor. For example, the initialization voltage VINI and the data voltage Vdata may have a waveform in which the initialization voltage VINI illustrated in FIGS. 5 and 12 to 14 is reversed.

Figure 31:
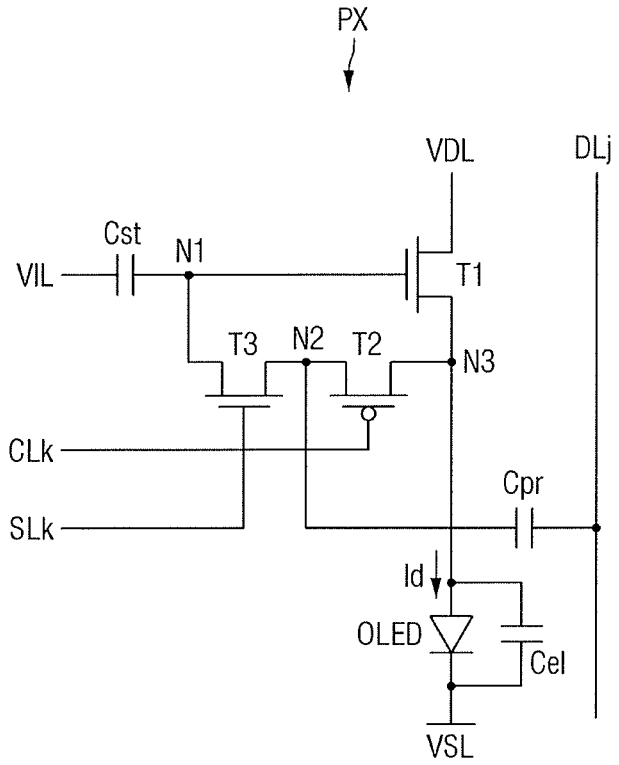
FIG. 31 illustrates a circuit diagram specifically showing an example of the subpixel according to an embodiment.

FIG. 31 is a circuit diagram specifically showing an example of the subpixel according to an embodiment. The embodiment illustrated in FIG. 31 is different from the embodiment illustrated in FIG. 15 in that the first transistor T1 is formed as an NMOS transistor.

Figure 32:
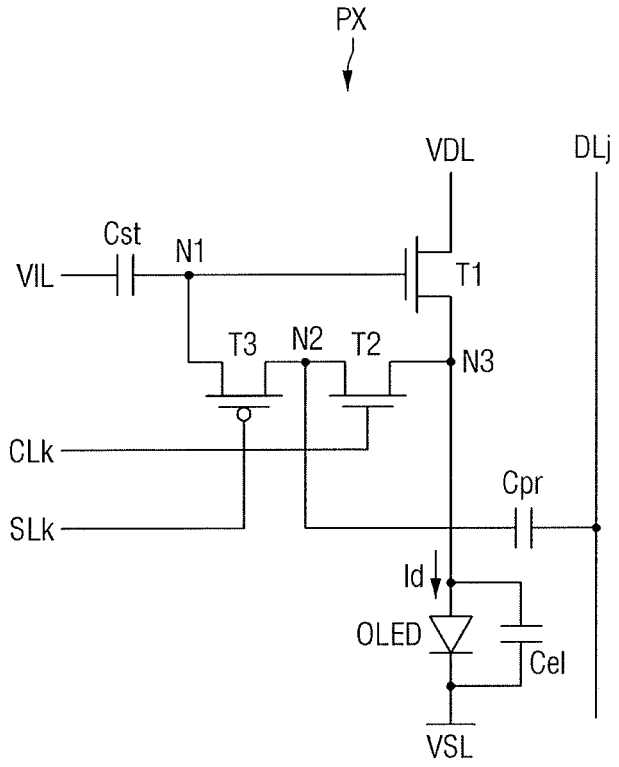
FIG. 32 illustrates a circuit diagram specifically showing an example of the subpixel according to an embodiment.

FIG. 32 is a circuit diagram specifically showing an example of the subpixel according to an embodiment. The embodiment illustrated in FIG. 32 is different from the embodiment illustrated in FIG. 16 in that the first transistor T1 is formed as an NMOS transistor.

Figure 33:
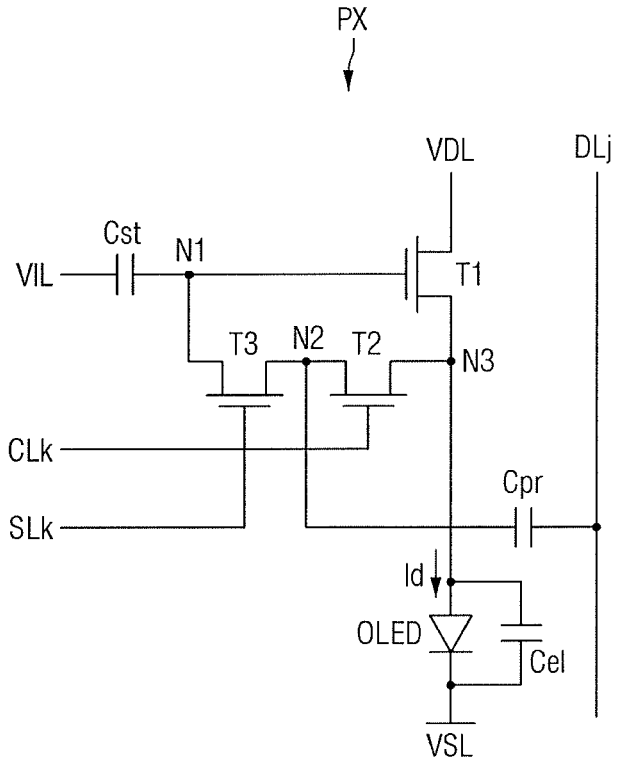
FIG. 33 illustrates a circuit diagram specifically showing an example of the subpixel according to an embodiment.

FIG. 33 is a circuit diagram specifically showing an example of the subpixel according to an embodiment. The embodiment illustrated in FIG. 33 is different from the embodiment illustrated in FIG. 17 in that the first transistor T1 is formed as an NMOS transistor.

Figure 34:
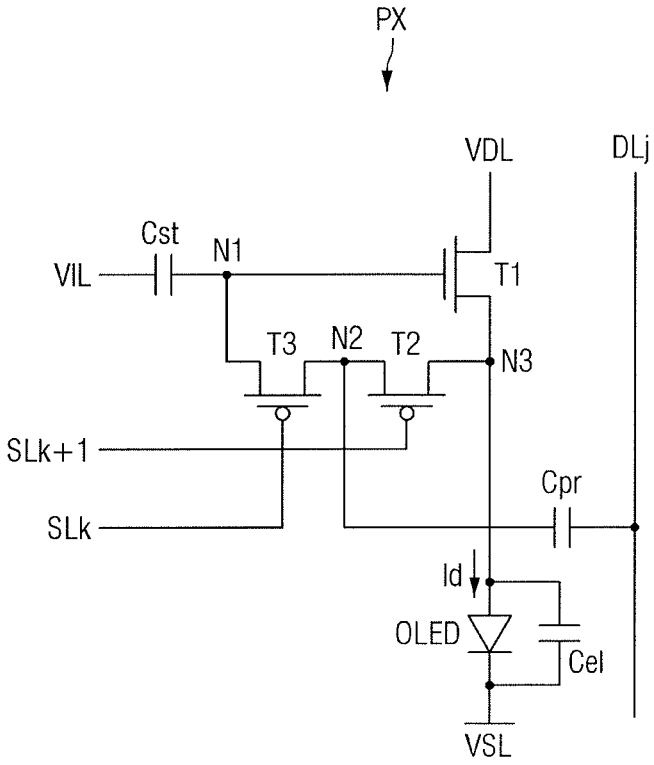
FIG. 34 illustrates a circuit diagram specifically showing an example of the subpixel according to an embodiment.

FIG. 34 is a circuit diagram specifically showing an example of the subpixel according to an embodiment. The embodiment illustrated in FIG. 34 is different from the embodiment illustrated in FIG. 18 in that the first transistor T1 is formed as an NMOS transistor.

Figure 35:
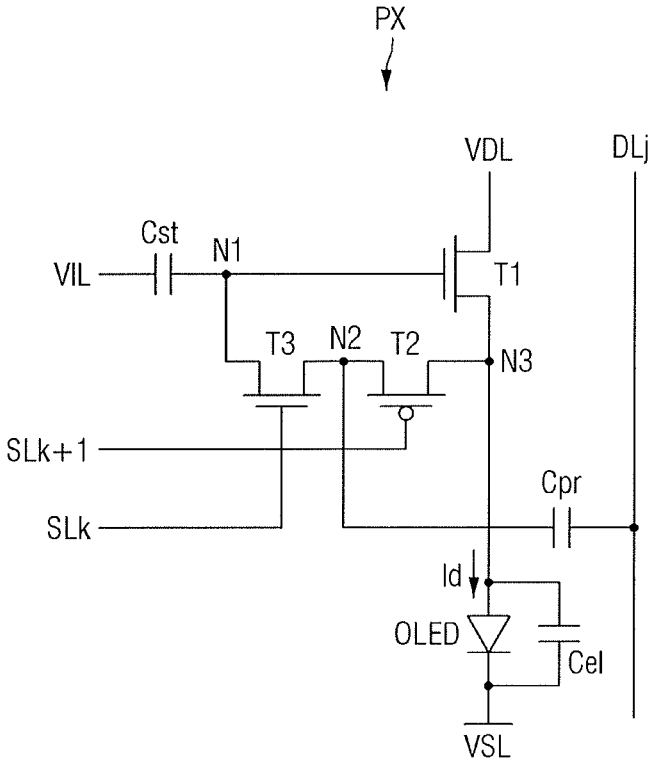
FIG. 35 illustrates a circuit diagram specifically showing an example of the subpixel according to an embodiment.

FIG. 35 is a circuit diagram specifically showing an example of the subpixel according to an embodiment. The embodiment illustrated in FIG. 35 is different from the embodiment illustrated in FIG. 19 in that the first transistor T1 is formed as an NMOS transistor.

Figure 36:
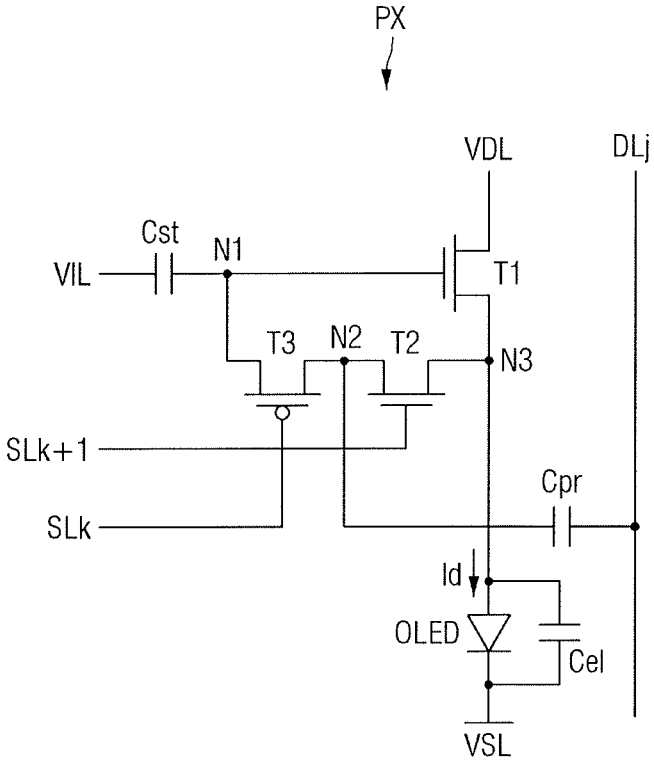
FIG. 36 illustrates a circuit diagram specifically showing an example of the subpixel according to an embodiment.

FIG. 36 is a circuit diagram specifically showing an example of the subpixel according to an embodiment. The embodiment illustrated in FIG. 36 is different from the embodiment illustrated in FIG. 20 in that the first transistor T1 is formed as an NMOS transistor.

Figure 37:
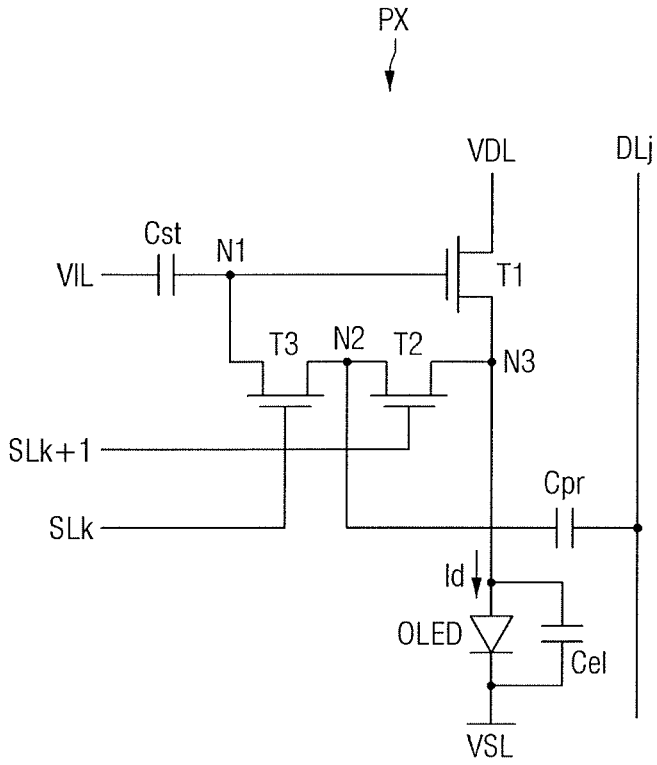
FIG. 37 illustrates a circuit diagram specifically showing an example of the subpixel according to an embodiment.

FIG. 37 is a circuit diagram specifically showing an example of the subpixel according to an embodiment. The embodiment illustrated in FIG. 37 is different from the embodiment illustrated in FIG. 21 in that the first transistor T1 is formed as an NMOS transistor.

Figure 38:
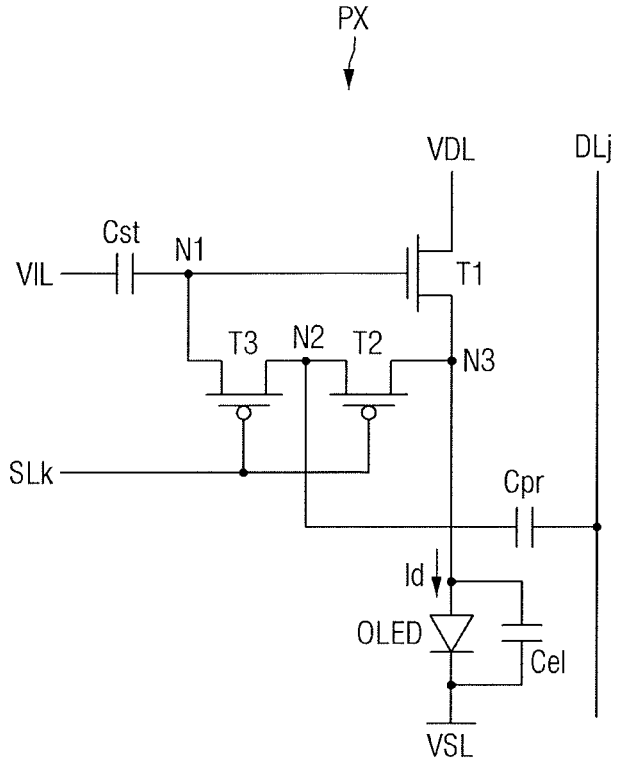
FIG. 38 illustrates a circuit diagram specifically showing an example of the subpixel according to an embodiment.

FIG. 38 is a circuit diagram specifically showing an example of the subpixel according to an embodiment. The embodiment illustrated in FIG. 38 is different from the embodiment illustrated in FIG. 22 in that the first transistor T1 is formed as an NMOS transistor.

Figure 39:
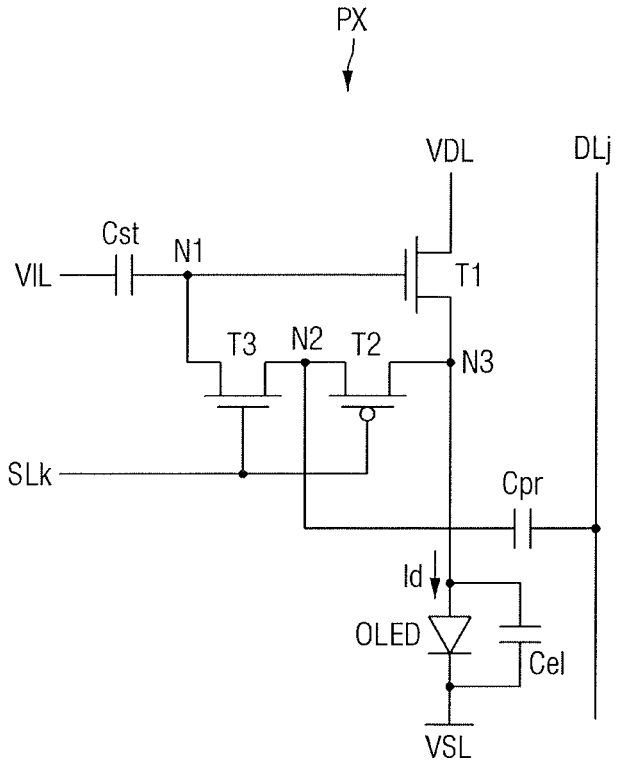
FIG. 39 illustrates a circuit diagram specifically showing an example of the subpixel according to an embodiment.

FIG. 39 is a circuit diagram specifically showing an example of the subpixel according to an embodiment. The embodiment illustrated in FIG. 39 is different from the embodiment illustrated in FIG. 23 in that the first transistor T1 is formed as an NMOS transistor.

Figure 40:
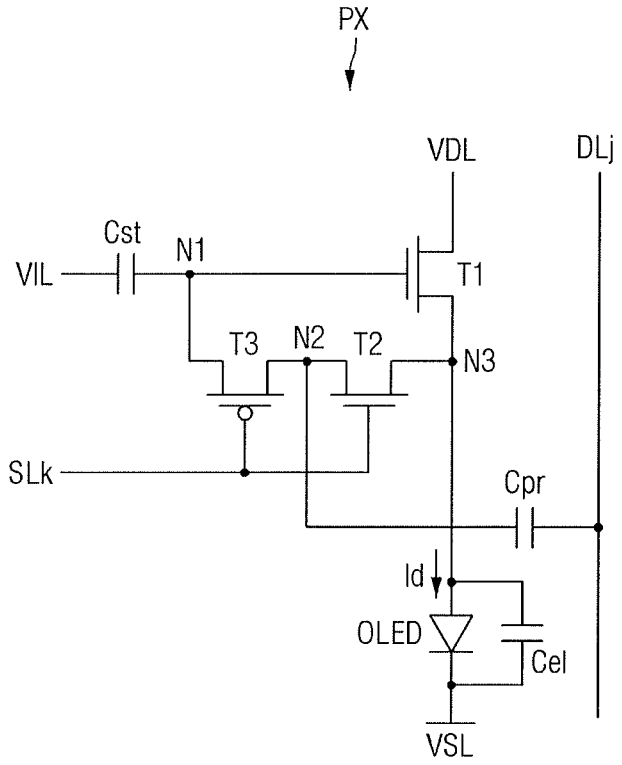
FIG. 40 illustrates a circuit diagram specifically showing an example of the subpixel according to an embodiment.

FIG. 40 is a circuit diagram specifically showing an example of the subpixel according to an embodiment. The embodiment illustrated in FIG. 40 is different from the embodiment illustrated in FIG. 24 in that the first transistor T1 is formed as an NMOS transistor.

Figure 41:
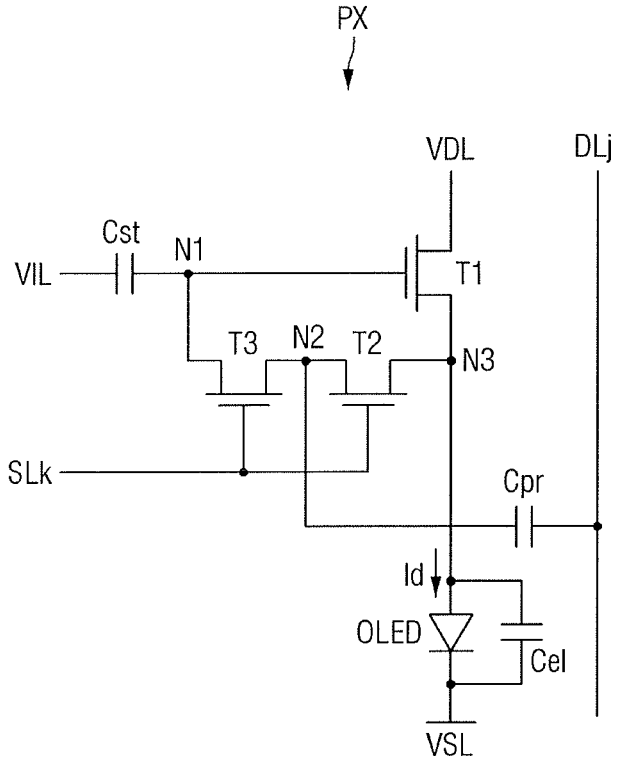
FIG. 41 illustrates a circuit diagram specifically showing an example of the subpixel according to an embodiment.

FIG. 41 is a circuit diagram specifically showing an example of the subpixel according to an embodiment. The embodiment illustrated in FIG. 41 is different from the embodiment illustrated in FIG. 25 in that the first transistor T1 is formed as an NMOS transistor.

Figure 42:
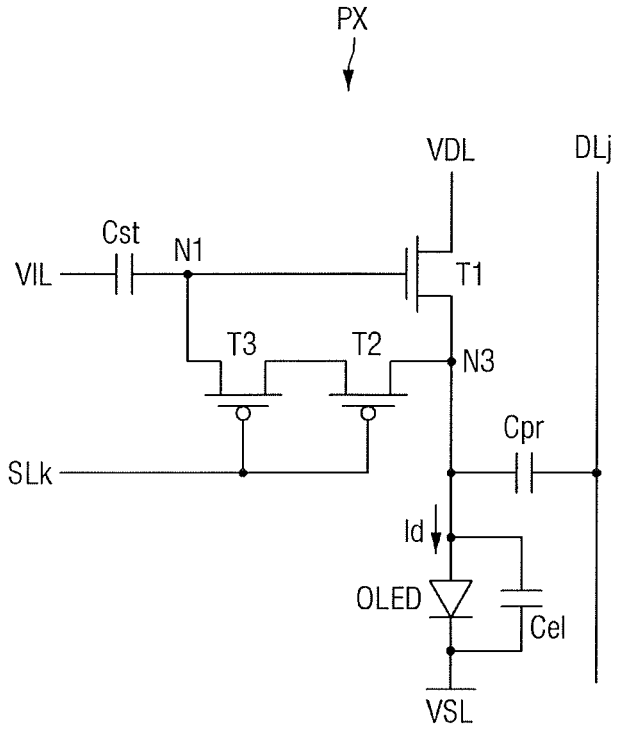
FIG. 42 illustrates a circuit diagram specifically showing an example of the subpixel according to an embodiment.

FIG. 42 is a circuit diagram specifically showing an example of the subpixel according to an embodiment. The embodiment illustrated in FIG. 42 is different from the embodiment illustrated in FIG. 26 in that the first transistor T1 is formed as an NMOS transistor.

Figure 43:
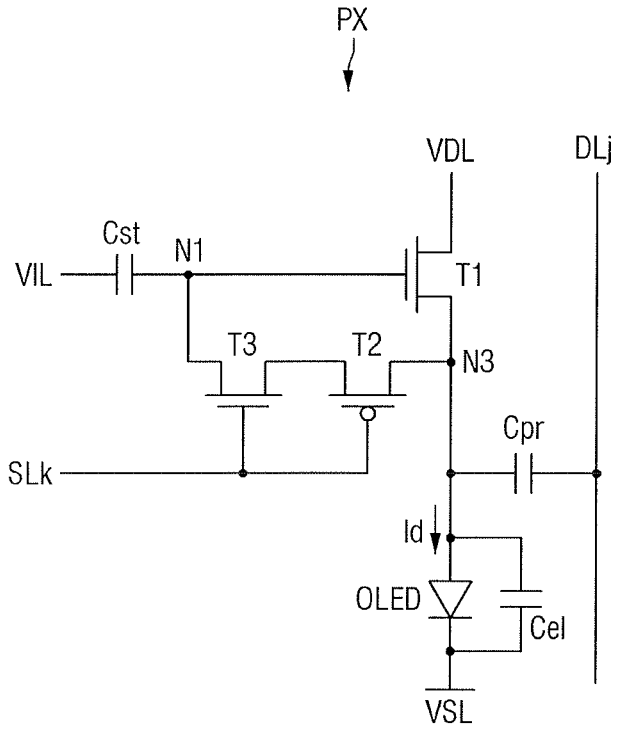
FIG. 43 illustrates a circuit diagram specifically showing an example of the subpixel according to an embodiment.

FIG. 43 is a circuit diagram specifically showing an example of the subpixel according to an embodiment. The embodiment illustrated in FIG. 43 is different from the embodiment illustrated in FIG. 27 in that the first transistor T1 is formed as an NMOS transistor.

Figure 44:
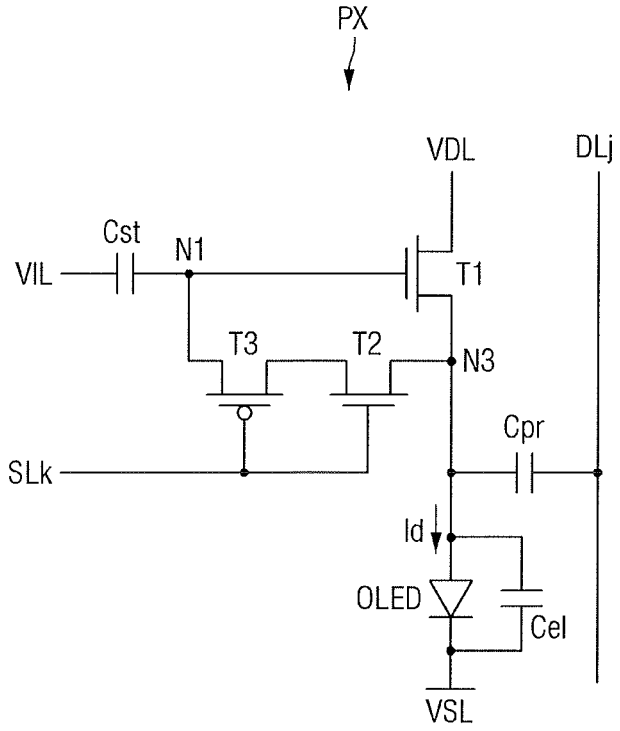
FIG. 44 illustrates a circuit diagram specifically showing an example of the subpixel according to an embodiment.

FIG. 44 is a circuit diagram specifically showing an example of the subpixel according to an embodiment. The embodiment illustrated in FIG. 44 is different from the embodiment illustrated in FIG. 28 in that the first transistor T1 is formed as an NMOS transistor.

Figure 45:
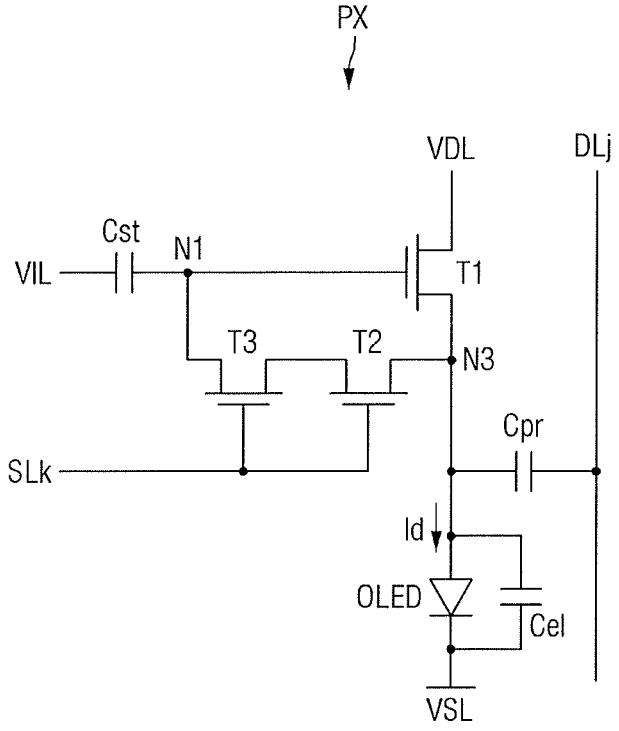
FIG. 45 illustrates a circuit diagram specifically showing an example of the subpixel according to an embodiment.

FIG. 45 is a circuit diagram specifically showing an example of the subpixel according to an embodiment. The embodiment illustrated in FIG. 45 is different from the embodiment illustrated in FIG. 29 in that the first transistor T1 is formed as an NMOS transistor.

Figure 46:
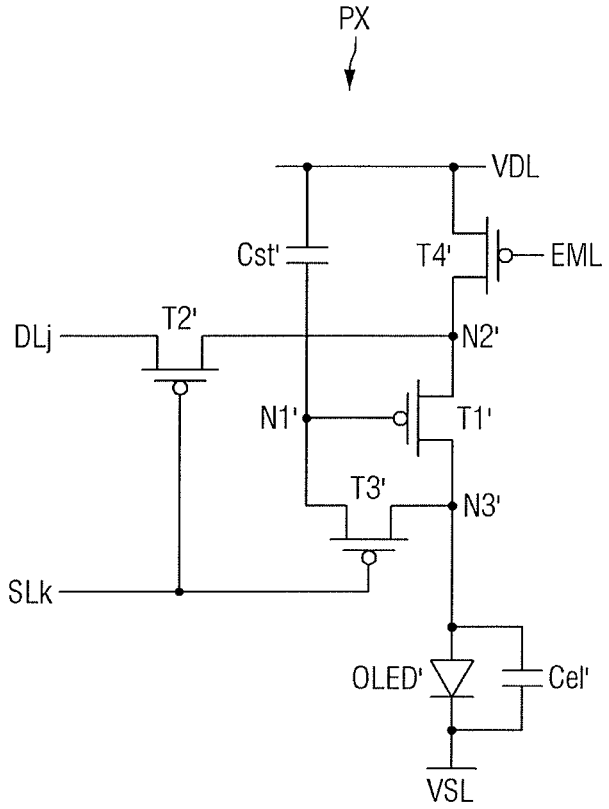
FIG. 46 illustrates a circuit diagram specifically showing an example of the subpixel according to an embodiment.

FIG. 46 is a circuit diagram specifically showing an example of the subpixel according to an embodiment. Referring to FIG. 46, the subpixel PX may be connected to the k-th scan line SLk, the j-th data line DLj, the first driving voltage line VSL to which a first driving voltage is applied, and the second driving voltage line VDL to which a second driving voltage is applied. The subpixel PX may include an organic light emitting diode OLED' as a light emitting element, a first transistor T1', a second transistor T2', a third transistor T3', a fourth transistor T4', and a first capacitor Cst'.

Although the case in which the first, second, third, and fourth transistors T1', T2', T3', and T4' are formed as PMOS transistors has been illustrated as an example in FIG. 4, embodiments are not limited thereto. For example, the first, second, third, and fourth transistors T1', T2', T3', and T4' may be formed as NMOS transistors, or some of the first, second, third, and fourth transistors T1', T2', T3', and T4' may be formed as PMOS transistors and the remainder thereof may be formed as NMOS transistors. The PMOS transistor is turned on by a gate-on voltage which is lower than a gate-off voltage, and the NMOS transistor is turned on by a gate-on voltage which is higher than a gate-off voltage.

The organic light emitting diode OLED' is a light emitting element and emits light according to a driving current Id' of the first transistor T1'. A light-emitting luminance of the organic light emitting diode OLED' may be proportional to the driving current Id'.

The organic light emitting diode OLED' may be an organic light emitting diode OLED including a first electrode, a second electrode, and an organic emissive layer disposed between the first electrode and the second electrode. Alternatively, instead of the organic light emitting diode OLED', an inorganic LED including a first electrode, a second electrode, and an inorganic semiconductor disposed between the first electrode and the second electrode may be used as the light emitting element. Alternatively, instead of the organic light emitting diode OLED', a quantum dot LED including a first electrode, a second electrode, and a quantum dot emissive layer disposed between the first electrode and the second electrode may be used as the light emitting element. Alternatively, instead of the organic light emitting diode OLED', a micro LED may be used as the light emitting element.

The first electrode of the organic light emitting diode OLED' may be connected to the third node, and the second electrode may be connected to the first driving voltage line VSL. A parasitic capacitance Cel' may be formed between the first electrode and the second electrode of the organic light emitting diode OLED'.

The first transistor T1' may be a driving transistor that controls a drain-source current Id' (hereinafter referred to as "driving current") according to the data voltage applied to the gate electrode. As shown in Equation 1, the driving current Id flowing via the channel of the first transistor T1' is proportional to a square of a difference between a voltage Vgs between the gate electrode and the first electrode of the first transistor T1' and a threshold voltage of the first transistor T1'.

The second transistor T2' is between a second node N2' and the j-th data line DLj. The second transistor T2' is turned on by a k-th scan signal of the k-th scan line SLk and connects the second node N2' and the j-th data line DLj. A gate electrode of the second transistor T2' may be connected to the k-th scan line SLk, a first electrode of the second transistor T2' may be connected to the second node N2', and a second electrode of the second transistor T2' may be connected to the j-th data line DLj.

The third transistor T3' is between a first node N1' and a third node N3'. The third transistor T3' is turned on by a k-th scan signal of the k-th scan line SLk and connects the first node N1' and the third node N3'. A gate electrode of the third transistor T3' may be connected to the k-th scan line SLk, a first electrode of the third transistor T3' may be connected to the third node N3', and a second electrode of the third transistor T3' may be connected to the first node N1'. When the third transistor T3' is turned on, since the gate electrode and the second electrode of the first transistor T1' are connected, the first transistor T1' operates as a diode.

The fourth transistor T4' is between the second node N2' and the second driving voltage line VDL. The fourth transistor T4' is turned on by a light emission signal of a light emission line EML and connects the second node N2' and the second driving voltage line VDL. A gate electrode of the fourth transistor T4' may be connected to the light emission line EML, a first electrode of the fourth transistor T4' may be connected to the second driving voltage line VDL, and a second electrode of the fourth transistor T4' may be connected to the second node N2'.

The first capacitor Cst' is between the first node N1' and the second driving voltage line VDL. The first capacitor Cst' may include a first capacitive electrode connected to the first node N1' and a second capacitive electrode connected to the second driving voltage line VDL.

When the first electrode of each of the first, second, third, and fourth transistors T1', T2', T3', and T4' is a source electrode, the second electrode may be a drain electrode. Alternatively, when the first electrode of each of the first, second, third, and fourth transistors T1', T2', T3', and T4' is a drain electrode, the second electrode may be a source electrode.

An active layer of the first transistor T1', an active layer of the second transistor T2', an active layer of the third transistor T3', and an active layer of the fourth transistor T4' may be formed of polysilicon, amorphous silicon, or an oxide semiconductor. Alternatively, some of the active layer of the first transistor T1', the active layer of the second transistor T2', the active layer of the third transistor T3', and the active layer of the fourth transistor T4' may be formed of polysilicon, and the remainder thereof may be formed of an oxide semiconductor. For example, the active layer of the first transistor T1' may be formed of polysilicon, and the active layer of the second transistor T2', the active layer of the third transistor T3', and the active layer of the fourth transistor T4' may be formed of an oxide semiconductor.

Figure 47:
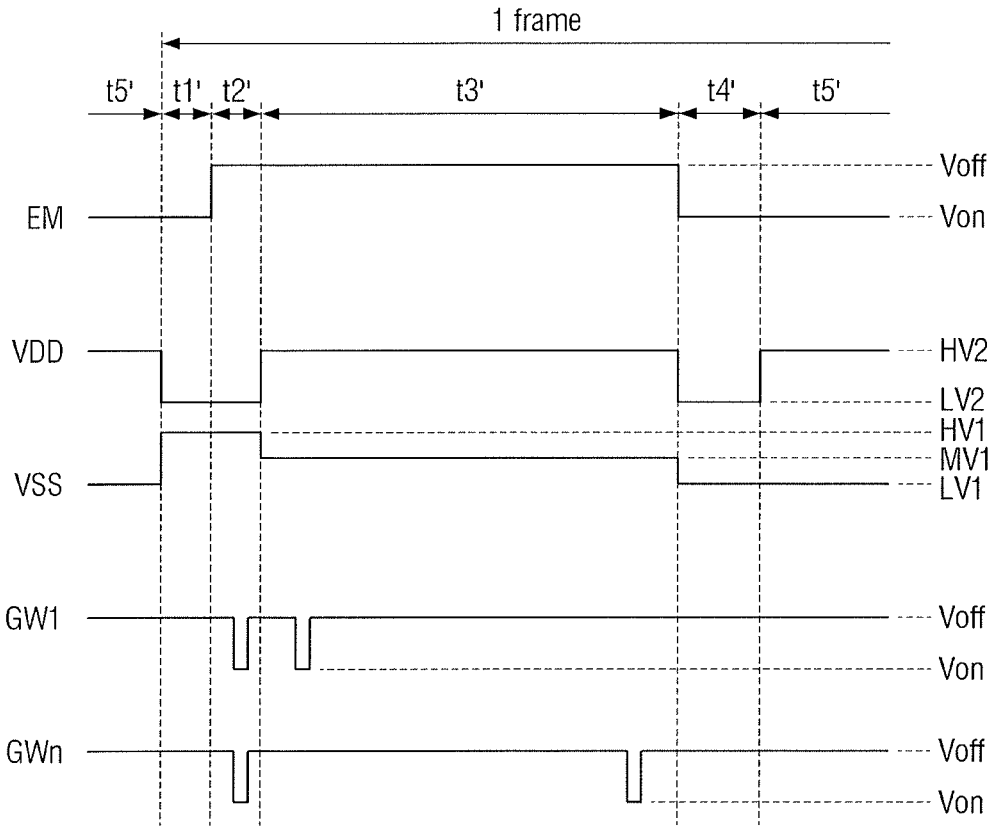
FIG. 47 illustrates a waveform diagram showing a first driving voltage, a second driving voltage, a k-th light emission signal, a first scan signal, and an n-th scan signal applied to the subpixel of FIG. 46.

FIG. 47 is a waveform diagram showing a first driving voltage, a second driving voltage, a k-th light emission signal, a first scan signal, and an n-th scan signal applied to the subpixel of FIG. 46.

Referring to FIG. 47, the first driving voltage VSS is a voltage applied to a cathode of the organic light emitting diode OLED, and the second driving voltage VDD is a voltage applied to the first electrode of the first transistor T1'. A first scan signal GW1 applied to a first scan line SL1 and an n-th scan signal GWn applied to an n-th scan line SLn may be signals for controlling turning-on and turning-off of the second transistor T2' and the third transistor T3'. A light emission signal EM applied to the light emission line EML is a signal for controlling turning-on and turning-off of the fourth transistor T4'.

The first driving voltage VSS, the second driving voltage VDD, the first scan signal GW1, the n-th scan signal GWn, and the light emission signal EM may be generated with a cycle of one frame period. The one frame period may include first to fifth periods t1' to t5'. The first period t1' may be an initialization period in which the second node N2' is initialized; the second period t2' may be an initialization period in which the first capacitor Cst' is initialized; the third period t3' may be a data-voltage-writing and threshold-voltage-storage period in which the data voltage of the j-th data line DLj is written into the first node N1' and a threshold voltage of the first transistor T1' is stored in the first capacitor Cst'; the fourth period t4' may be an initialization period in which the third node N3' is initialized; and the fifth period t5' may be a light emission period in which the organic light emitting diode OLED' emits light.

The subpixels PX of the display panel 100 simultaneously initialize the second node N2' and initialize the first capacitor Cst' during the first and second periods t1' and t2'. Then, the subpixels PX of the display panel 100 write the data voltage into the first node N1' sequentially for each scan line and store the threshold voltage of the first transistor T1' in the first capacitor Cst' during the third period t3'. Then, the subpixels PX of the display panel 100 simultaneously initialize the third node N3' during the fourth period t4' and simultaneously emit light using the organic light emitting diode OLED' during the fifth period t5'.

The first driving voltage VSS has a first high-level voltage HV1 during the first and second periods t1' and t2', has a first mid-level MV1 during the third period t3', is changed from the first high-level voltage HV1 to a first low-level voltage LV1 during the fourth period t4', and has the first low-level voltage LV1 during the fifth period t5'. The second driving voltage VDD has a second low-level voltage LV2 during the first and second periods t1' and t2', has a second high-level voltage HV2 during the third period t3', has the second low-level voltage LV2 during the fourth period t4', and has the second high-level voltage HV2 during the fifth period fifth period t5'.

Each of the first scan signal GW1 and the n-th scan signal GWn has a gate-off voltage Voff during the first period t1', has a gate-on voltage Von during the second period t2', has a pulse having the gate-on voltage Von at least once during the third period t3', and has the gate-off voltage Voff during the fourth and fifth periods t4' and t5'. The light emission signal EM may have a gate-on voltage Von during the first period t1', have a gate-off voltage Voff during the second period t2' and the third period t3', and have the gate-on voltage Von during the fourth and fifth periods t4' and t5'.

The first high-level voltage HV1 and the second high-level voltage HV2 may be substantially the same voltages. The first low-level voltage LV1 and the second low-level voltage LV2 may be substantially the same, or the first low-level voltage LV1 may be lower than the second low-level voltage LV2. The first mid-level voltage MV1 may be a voltage between the first high-level voltage HV1 and the first low-level voltage LV1. The gate-on voltage Von corresponds to a voltage capable of turning on the first to fourth transistors T1', T2', T3', and T4'. The gate-off voltage Voff corresponds to a voltage capable of turning off the first to fourth transistors T1', T2', T3', and T4'.

FIGS. 48 to 52 are circuit diagrams showing operations of the subpixel during first to fourth periods.

First, as illustrated in FIG. 47, during the first period t1', the first driving voltage VSS has the first high-level voltage HV1, and the second driving voltage VDD has the second low-level voltage LV2. During the first period t1', the scan signals GW1 to GWn have the gate-off voltage Voff, and the light emission signal EM has the gate-on voltage Von. Thus, during the first period t1', the second transistor T2' and the third transistor T3' are turned off, and the fourth transistor T4' is turned on.

Figure 48:
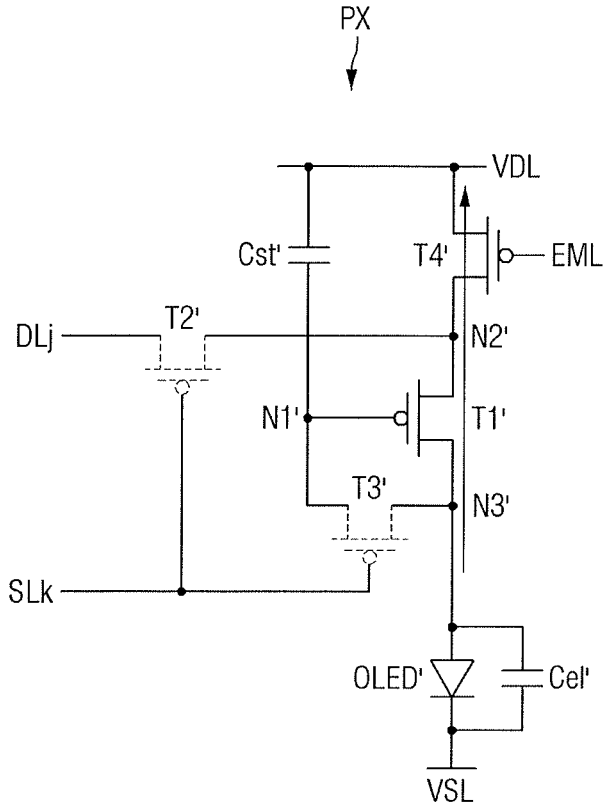
FIGS. 48 to 52 illustrate circuit diagrams showing operations of the subpixel during first to fourth periods.

As illustrated in FIG. 48, since the fourth transistor T4' is turned on during the first period t1', the second node N2' may be discharged at the second low-level voltage LV2. Since a voltage difference between the gate electrode and the first electrode of the first transistor T1' becomes higher than the threshold voltage of the first transistor T1', the first transistor T1' may be turned on, and the third node N3' may be initialized. In this case, since the first driving voltage VSS has the first high-level voltage HV1 and the second driving voltage VDD has the second low-level voltage LV2, the organic light emitting diode OLED' may not emit light.

Second, as illustrated in FIG. 47, during the second period t2', the first driving voltage VSS has the first high-level voltage HV1, and the second driving voltage VDD has the second low-level voltage LV2. During the second period t2', the scan signals GW1 to GWn have the gate-on voltage Von, and the light emission signal EM has the gate-off voltage Voff. Thus, during the second period t2', the second transistor T2' and the third transistor T3' are turned on, and the fourth transistor T4' is turned off.

Figure 49:
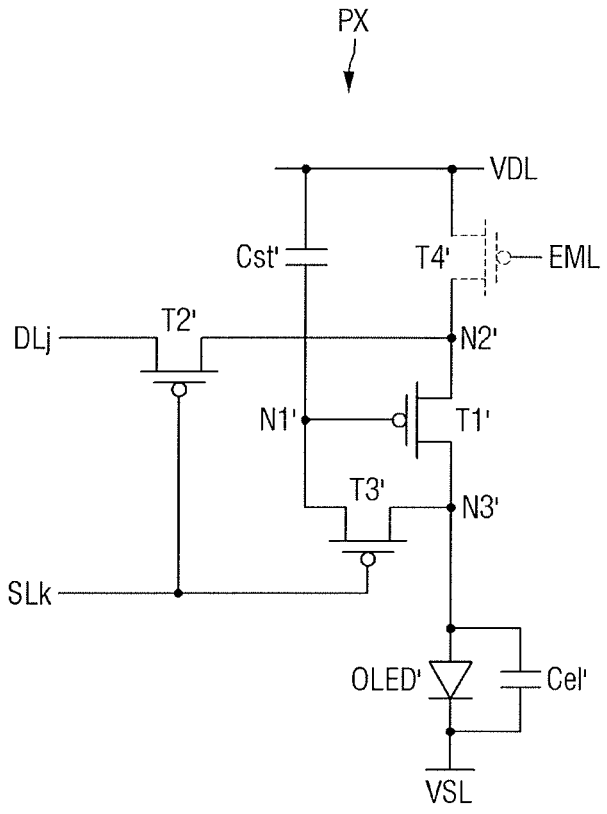

As illustrated in FIG. 49, since the second transistor T2' and the third transistor T3' are turned on during the second period t2', charge sharing occurs between the first node N1' and the third node N3'. Accordingly, since the first capacitive electrode and the second capacitive electrode of the first capacitor Cst' have the same voltage, the first capacitor Cst' may be initialized.

Third, as illustrated in FIG. 47, during the third period t3', the first driving voltage VSS has the first mid-level voltage MV1, and the second driving voltage VDD has the second high-level voltage HV2. During the third period t3', the first driving voltage VSS may have the first high-level voltage HV1 instead of the first mid-level voltage MV1. However, when the first driving voltage VSS has the first mid-level voltage MV1, it is possible to better prevent a reverse leakage current from flowing in the organic light emitting diode OLED', as compared with when the first driving voltage VSS has the first high-level voltage HV1.

During the third period t3', each of the scan signals GW1 to GWn has the pulse having the gate-on voltage Von at least once, and the light emission signal EM has the gate-off voltage Voff. Thus, during the third period t3', the second transistor T2' and the third transistor T3' are synchronized with the pulse having the gate-on voltage Von at least once and are turned on, and the fourth transistor T4' is turned off.

Figure 50:
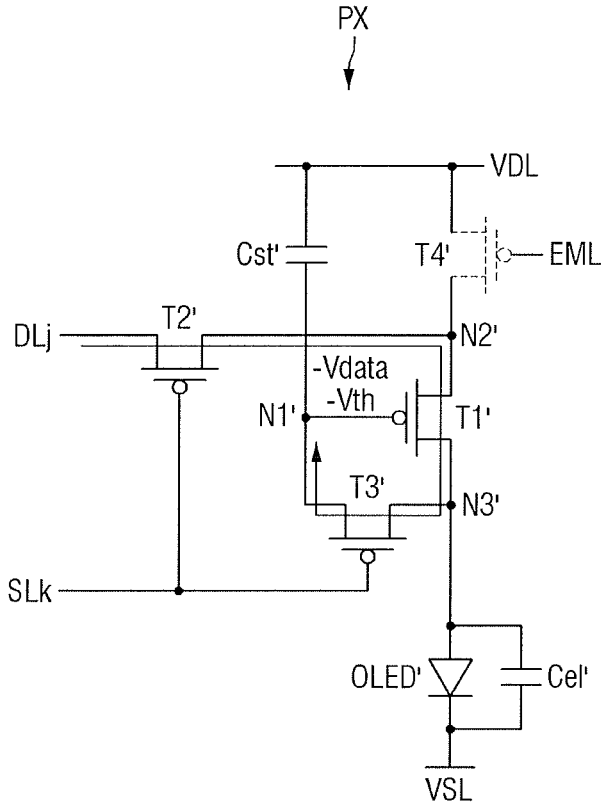

When the second transistor T2' is turned on during the third period t3', a data voltage Vdata is applied to the second node N2'. When the third transistor T3' is turned on during the third period t3', since the gate electrode and the second electrode of the first transistor T1' are connected, the first transistor T1' operates as a diode. When the data voltage Vdata is applied to the second node N2', the voltage between the gate electrode and the first electrode of the first transistor T1' may become higher than the threshold voltage of the first transistor T1'. Therefore, the first transistor T1' may form a current path until the voltage between the gate electrode and the first electrode reaches the threshold voltage of the first transistor T1'. Accordingly, as illustrated in FIG. 50, in the first transistor T1', a voltage of the gate electrode, i.e., a voltage VN1 of the first node N1', may rise up to a voltage difference (Vdata−Vth) between the data voltage Vdata and the threshold voltage Vth of the first transistor T1'. The voltage difference (Vdata−Vth) between the data voltage Vdata and the threshold voltage Vth of the first transistor T1' may be stored in the first capacitor Cst'.

Fourth, as illustrated in FIG. 47, during the fourth period t4', the first driving voltage VSS is changed from the first high-level voltage HV1 to the first low-level voltage LV1, and the second driving voltage VDD has the second low-level voltage LV2. During the fourth period t4', the scan signals GW1 to GWn have the gate-off voltage Voff, and the light emission signal EM has the gate-on voltage Von. Thus, during the fourth period t4', the second transistor T2' and the third transistor T3' are turned off, and the fourth transistor T4' is turned on.

Figure 51:
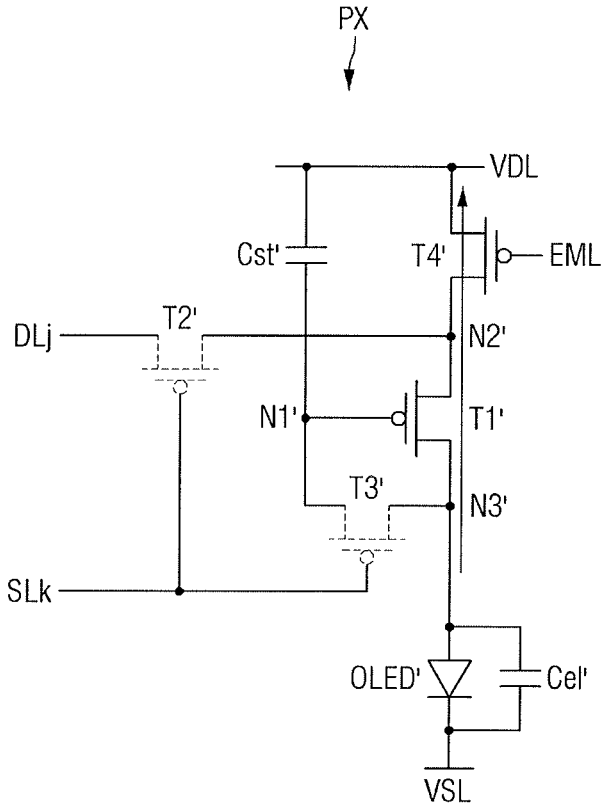

Since the second low-level voltage LV2 is applied to the second node N2' during the fourth period t4', the voltage difference between the gate electrode and the first electrode of the first transistor T1' may become higher than the threshold voltage of the first transistor T1'. Accordingly, the first transistor T1' may be turned on, and, as illustrated in FIG. 51, the third node N3' may be initialized to the second low-level voltage LV2 of the second driving voltage VDD.

According to the embodiment illustrated in FIGS. 47 to 51, when, in the fourth period t4', the first driving voltage VSS is changed from the first mid-level voltage MV1 to the first low-level voltage LV1, it is possible to prevent the change amount of the first driving voltage VSS from being reflected to the third node N3' due to a parasitic capacitance Cel' of the organic light emitting diode OLED'. In this case, since it is possible to prevent the voltage of the third node N3' from being lowered, even when, during the fifth period t5', the organic light emitting diode OLED' emits light with a low-gradation luminance and thus the driving current Id' is small, the time taken for charging the parasitic capacitance Cel' of the organic light emitting diode OLED' may be reduced. Therefore, since it is possible to advance a light emitting time point of the organic light emitting diode OLED' in the fifth period t5', degradation in image quality, e.g., a low-gradation stain, may be prevented or reduced.

Also, the second low-level voltage LV2 of the second driving voltage VDD may be higher than the first low-level voltage LV1 of the first driving voltage VSS. In this case, even when, during the fifth period t5', the organic light emitting diode OLED' emits light with a low-gradation luminance and thus the driving current Id' is small, the time taken for charging the parasitic capacitance Cel' of the organic light emitting diode OLED' may be reduced. Therefore, since it is possible to advance the light emitting time point of the organic light emitting diode OLED' in the fifth period t5', degradation in image quality, e.g., a low-gradation stain, may be prevented or reduced.

Fifth, as illustrated in FIG. 47, during the fifth period t5', the first driving voltage VSS has the first low-level voltage LV1, and the second driving voltage VDD has the second high-level voltage HV2. During the fifth period t5', the scan signals GW1 to GWn have the gate-off voltage Voff, and the light emission signal EM has the gate-on voltage Von. Thus, during the fifth period t5', the second transistor T2' and the third transistor T3' are turned off, and the fourth transistor T4' is turned on.

Figure 52:
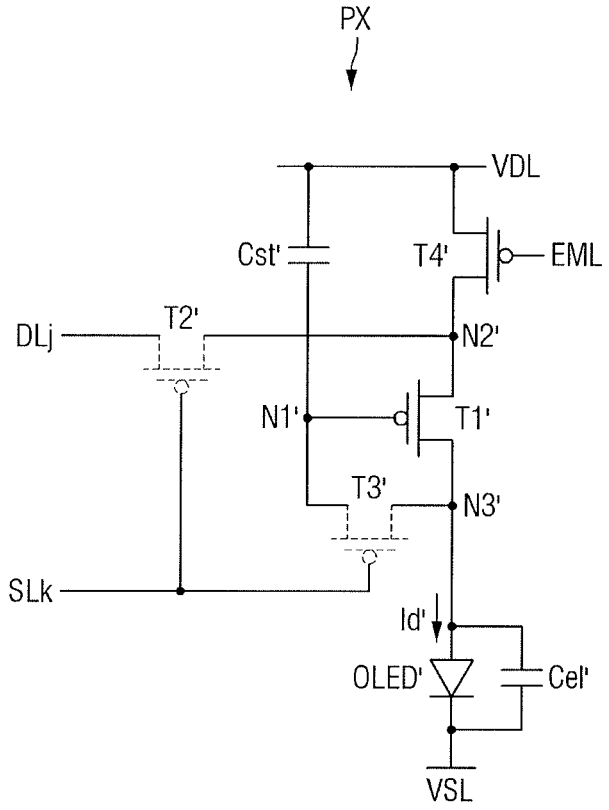

As illustrated in FIG. 52, during the fifth period t5', the driving current Id' of the first transistor T1' may flow to the organic light emitting diode OLED' according to the voltage (Vdata−Vth) of the first node N1'. The driving current Id' of the first transistor T1' may be defined as Equation 4 below.

$$Id=k'\times(HV2-(V\text{data}-Vth)-Vth)^2 \quad \text{[Equation 4]}$$

When Equation 4 is simplified, Equation 5 is derived.

$$Id=k'\times(HV2-Vth)^2 \quad \text{[Equation 5]}$$

As in Equation 5, the driving current Id' does not depend on the threshold voltage Vth of the first transistor T1'. That is, the threshold voltage Vth of the first transistor T1' is compensated for.

Figure 53:
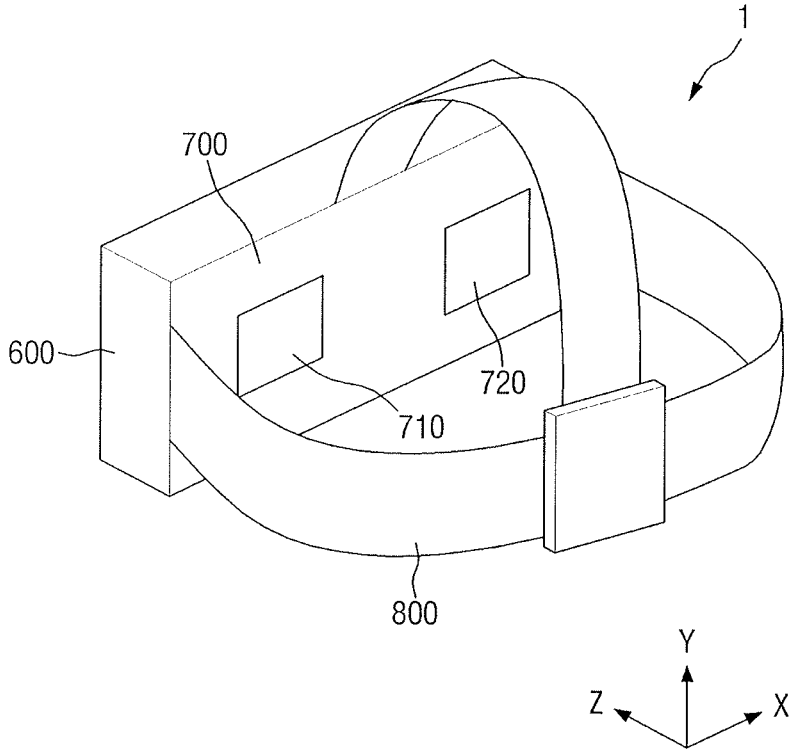
FIG. 53 illustrates a perspective view of an example of a head-mounted display to which the display device according to an embodiment is applied.
Figure 54:
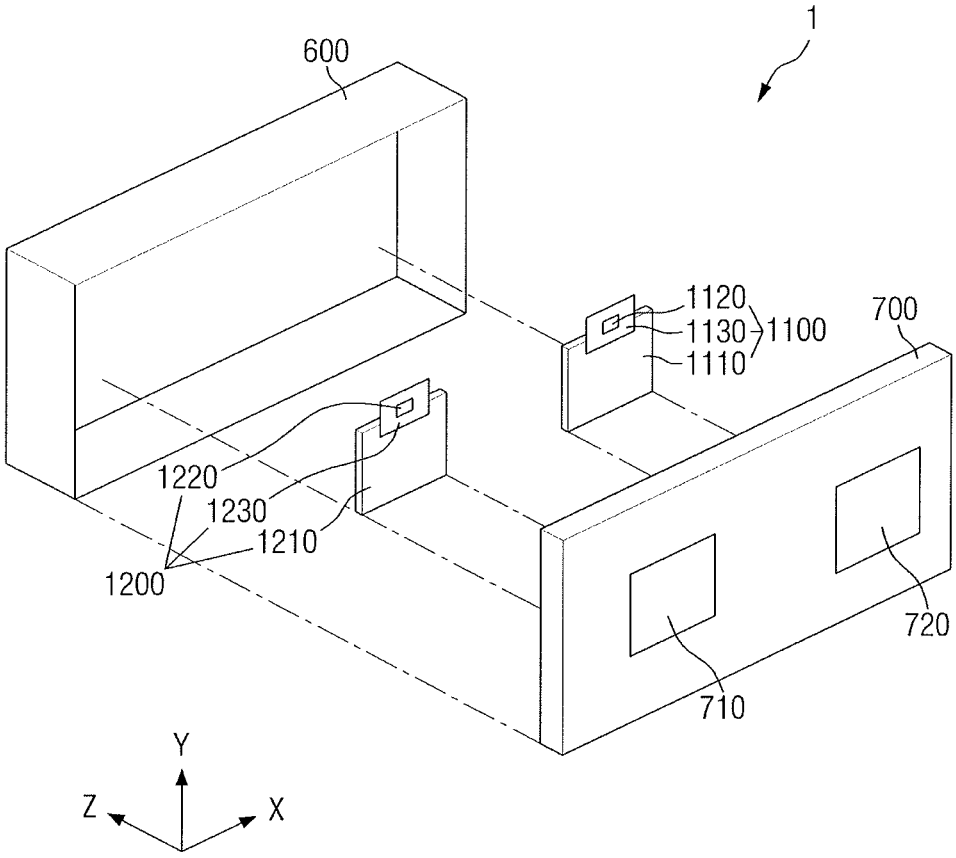
FIG. 54 illustrates an exploded perspective view specifically showing a display panel storage unit of FIG. 53.

FIG. 53 is a perspective view illustrating an example of a head-mounted display to which the display device according to an embodiment is applied. FIG. 54 is an exploded perspective view specifically showing a display panel storage unit of FIG. 53.

Referring to FIGS. 53 and 54, a head-mounted display 1 according to an embodiment includes a first display device 1100, a second display device 1200, a display panel storage unit 600, a storage unit cover 700, a first ocular 710, a second ocular 720, and a head-mounted band 800.

The first display device 1100 may include a first display panel 1110, a first circuit board 1130, and a first display driving circuit 1120, and the second display device 1200 may include a second display panel 1210, a second circuit board 1230, and a second display driving circuit 1220.

Since the first display device 1100 and the second display device 1200 are substantially the same as the display device 10 described above with reference to FIGS. 1 to 3, descriptions of the first display device 1100 and the second display device 1200 will be omitted.

The display panel storage unit 600 serves to store the first display device 1100 and the second display device 1200. In order to store the first display device 1100 and the second display device 1200, one surface of the display panel storage unit 600 may be open. The form of the display panel storage unit 600 is not limited to those illustrated in FIGS. 53 and 54.

The storage unit cover 700 is disposed to cover the one open surface of the display panel storage unit 600. The storage unit cover 700 may include the first ocular 710 at which the left eye of a user is placed and the second ocular 720 at which the right eye of the user is placed. Although the case in which the first ocular 710 and the second ocular 720 are formed in a quadrangular shape has been illustrated as an example in FIGS. 53 and 54, embodiments are not limited thereto. The first ocular 710 and the second ocular 720 may be formed in a circular shape or an elliptical shape. Alternatively, the first ocular 710 and the second ocular 720 may be combined and form a single opening.

The first ocular 710 may be aligned with the first display device 1100, and the second ocular 720 may be aligned with the second display device 1200. Therefore, the user may view an image of the first display device 1100 via the first ocular 710 and view an image of the second display device 1200 via the second ocular 720. The first ocular 710 and the second ocular 720 may be convex lenses.

Although the case in which the display device according to an embodiment is applied to the head-mounted display 1 has been illustrated as an example in FIGS. 53 and 54, embodiments are not limited thereto. That is, in addition to being applied to the head-mounted display 1, the display device according to an embodiment may also be applied to high pixel-per-inch (PPI) products. For example, the display device according to an embodiment may be applied to electronic devices, such as a smartphone, a tablet PC, and a vehicle display device, that require a small-sized display device.

According to the display device according to embodiments, since a first driving voltage is changed from a first high-level voltage to a first low-level voltage during a period in which an initialization voltage has a second level voltage, it is possible to prevent a change amount of the first driving voltage from being reflected to a third node due to a parasitic capacitance of an organic light emitting diode OLED. In this case, since it is possible to prevent a voltage of the third node from being lowered, even when the organic light emitting diode OLED emits light with a low-gradation luminance and thus a driving current is small, the time taken for charging the parasitic capacitance of the organic light emitting diode OLED may be reduced. Therefore, since it is possible to improve delay of a light emitting time point of the organic light emitting diode OLED, degradation in image quality, e.g., a low-gradation stain, may be prevented or reduced.

Also, according to the display device according to embodiments, a second low-level voltage of a second driving voltage may be higher than the first low-level voltage of the first driving voltage. In this case, even when the organic light emitting diode OLED emits light with a low-gradation luminance and thus the driving current is small, it is possible to reduce the time taken for charging the parasitic capacitance of the organic light emitting diode OLED. Therefore, since it is possible to improve the delay of the light emitting time point of the organic light emitting diode OLED, degradation in image quality, e.g., a low-gradation stain, may be prevented or reduced.

Also, according to the display device according to embodiments, since an on-bias is applied to a first transistor, when it is attempted to display a black luminance and then display a white luminance, a driving current of the first transistor increases stepwise due to a hysteresis characteristic of a driving transistor, a stepwise increase of a luminance of the organic light emitting diode OLED may be improved.

According to the display device according to embodiments, a subpixel includes a second transistor between a second node and the third node. Accordingly, since the second node and the third node may be separated by the second transistor, even when a leakage current that flows from a second driving voltage line to the third node via the first transistor is generated while a data voltage of a data line is applied to a gate electrode (or a first node) of the first transistor, the data voltage of the data line applied to the gate electrode of the first transistor is not affected, such that degradation in display quality may be prevented or reduced.

According to the display device according to embodiments, since a second capacitor is between the second node and the data line, a decrease in luminance of a light emitting element due to a parasitic capacitor of an electrode overlapping the first node may be prevented or reduced. Accordingly, degradation in display quality may be prevented or reduced.

Advantageous effects according to the embodiments are not limited to those described above, and various other advantageous effects are incorporated herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a data line to which a data voltage is applied;

a first driving voltage line to which a first driving voltage is applied;

a second driving voltage line to which a second driving voltage is applied; and a pixel connected to the first driving voltage line and the second driving voltage line, wherein the pixel includes:

a first transistor configured to control a driving current flowing between a first electrode and a second electrode according to a voltage applied to a first node;

a light emitting element between the first transistor and the first driving voltage line; and a capacitor between the first node and the second driving voltage line, wherein the first driving voltage has a first high-level voltage during a first initialization period for initializing the capacitor, and the first driving voltage has a first mid-level voltage lower than the first high-level voltage during a threshold-voltage-storage period for storing a threshold-voltage to the capacitor, and the first driving voltage has a first low-level voltage during a second initialization period for initializing a first electrode of the light emitting element.

2. The display device as claimed in claim 1, wherein the threshold-voltage-storage period follows the first initialization period, and the second initialization period follows the threshold-voltage-storage period.

3. The display device as claimed in claim 1, wherein the second driving voltage has a second low-level voltage during the first initialization period and the second initialization period, and the second driving voltage has a second high-level voltage during the threshold-voltage-storage period.

4. The display device as claimed in claim 3, wherein the first low-level voltage is equal to the second low-level voltage.

5. The display device as claimed in claim 3, wherein the first low-level voltage is higher than the second low-level voltage.

6. The display device as claimed in claim 3, wherein the first high-level voltage is equal to the second high-level voltage.

7. The display device as claimed in claim 1, wherein the pixel further includes:

a second transistor between the data line and a second node connected to the first electrode of the first transistor;

a third transistor between the first node and a third node connected to the second electrode of the first transistor; and a fourth transistor between the second node and the second driving voltage line.

8. The display device as claimed in claim 7, wherein the first driving voltage has the first high-level voltage during a third initialization period for initializing the third node, and the first driving voltage has the first low-level voltage during a light emission period in which the light emitting element emits light.

9. The display device as claimed in claim 8, wherein the first initialization period follows the third initialization period, and the light emission period follows the second initialization period.

10. The display device as claimed in claim 8, the second driving voltage is applied to the third node during the first initialization period and the third initialization period.

11. The display device as claimed in claim 8, the second driving voltage is applied to the first node during the first initialization period.

12. The display device as claimed in claim 7, wherein a gate electrode of the second transistor and a gate electrode of the third transistor are connected to the same line.

13. The display device as claimed in claim 7, wherein a gate electrode of the second transistor and a gate electrode of the third transistor are connected to a scan line to which a scan signal is applied, and a gate electrode of the fourth transistor is connected to a light emission line to which a light emission signal is applied.

14. The display device as claimed in claim 13, wherein the scan signal has a gate-on voltage during at least a partial period in each of the first initialization period and the threshold-voltage-storage period.

15. The display device as claimed in claim 14, wherein the scan signal has a gate-off voltage during the second initialization period, the third initialization period, and the light emission period.

16. The display device as claimed in claim 15, wherein the gate-on voltage is lower than the gate-off voltage.

17. The display device as claimed in claim 13, wherein the light emission signal has a gate-on voltage during the second initialization period, the third initialization period, and the light emission period.

18. The display device as claimed in claim 17, wherein the light emission signal has a gate-off voltage during the first initialization period and the threshold-voltage-storage period.

19. The display device as claimed in claim 18, wherein the gate-on voltage is lower than the gate-off voltage.

20. The display device as claimed in claim 7, wherein the first transistor, the second transistor, the third transistor and the fourth transistor are a P-type transistor.

* * * * *